US006568164B2

(12) United States Patent
Kusakari et al.

(10) Patent No.: US 6,568,164 B2
(45) Date of Patent: May 27, 2003

(54) SPINNING RING FOR A RING SPINNING MACHINE AND METHOD OF MANUFACTURING THEREOF

(75) Inventors: Ryohei Kusakari, Nishinomiya (JP); Masamichi Hamaguchi, Nishinomiya (JP); Naohumi Kobayashi, Itami (JP); Yoshihumi Nariyama, Hirakata (JP)

(73) Assignee: Kanai Juyo Kogyo Co., Ltd., Itami (JP)

( * ) Notice: Subject to any disclaimer, the term of this patent is extended or adjusted under 35 U.S.C. 154(b) by 0 days.

(21) Appl. No.: 09/975,076

(22) Filed: Oct. 12, 2001

(65) Prior Publication Data

US 2003/0070412 A1 Apr. 17, 2003

(51) Int. Cl.[7] ..... D01H 7/52
(52) U.S. Cl. ..... 57/119
(58) Field of Search ..... 57/75, 112, 119, 57/120, 121, 122, 123, 124, 137

(56) References Cited

U.S. PATENT DOCUMENTS

| | | | | | |
|---|---|---|---|---|---|
| 216,345 | A | * | 6/1879 | Pierce | 57/119 |
| 807,601 | A | * | 12/1905 | Coe | 57/119 |
| 893,443 | A | * | 7/1908 | Chapman | 57/122 |
| 1,226,661 | A | * | 5/1917 | Hine | 57/119 |
| 1,265,924 | A | * | 5/1918 | Lanning | 57/119 |
| 1,351,595 | A | | 8/1920 | White | |
| 1,807,861 | A | * | 6/1931 | Munson | 57/123 |
| 2,090,137 | A | * | 8/1937 | McLeod | 57/307 |
| 2,128,614 | A | | 8/1938 | Kobayashi | |
| 3,236,040 | A | * | 2/1966 | Gisinger | 57/119 |
| 3,304,707 | A | * | 2/1967 | Kluttz | 57/120 |

FOREIGN PATENT DOCUMENTS

| | | | | |
|---|---|---|---|---|
| CH | 111 536 | | 12/1925 | |
| JP | 40-16208 | | 7/1940 | |
| JP | 05179523 A | * | 7/1993 | D01H/7/60 |
| JP | 6-47768 | | 6/1994 | |
| WO | WO97/24477 A1 | | 7/1997 | |

* cited by examiner

*Primary Examiner*—John J. Calvert
*Assistant Examiner*—Shaun R Hurley
(74) *Attorney, Agent, or Firm*—Browdy and Neimark, P.L.L.C.

(57) ABSTRACT

A spinning ring, in which a ring flange portion 101 making a track permitting a ring traveller to run thereon is divided into an inner flange 103 and an outer flange 106, the inner flange 103 is continuously formed from a sheet steel, the outer flange is formed together and integral with a ring neck portion 109 and a mount portion 102 by cutting, the inner flange 103 and the outer flange 106 are secured to each other by a securing means, and a ring flange portion 101 is provided in an upper portion of the spinning ring 100. The spinning ring enables enhancing the ring flange portion in accuracy and wear resistance, and preventing fine vibrations of the ring flange portion from causing abnormal wear of and shortening of service life of a ring traveller and the ring flange portion and frequent yarn breakage leading to reduction in productivity and falling-off of the ring flange portion due to shock.

13 Claims, 16 Drawing Sheets

SPINNING RING FOR A RING SPINNING MACHINE AND METHOD OF MANUFACTURING THEREOF

BACKGROUND OF THE INVENTION

1. Field of Invention

The invention relates to a spinning ring for use in ring spinning machines and ring twisting machines, and a method of manufacturing the same.

2. Description of the Prior Art

Conventionally, a spinning ring used in ring spinning machines has been known, in which a cylindrical-shaped blank stock is subjected to cutting work to form a ring flange portion and a mount portion integrally, as well as one which is described in, for example, Japanese Patent Publication No. 16208/1965, and formed as a whole from a sheet steel with a view to automation of manufacturing process, enhanced accuracy, cost reduction, lightening or the like, and one which is described in, for example, Japanese Patent Publication No. 47768/1994, and in which a ring flange portion slidingly contacting with a ring traveller is formed from ceramics and fittingly secured to a neck portion of a ring body for enhanced wear resistance.

FIG. 20 shows a spinning ring 1300 described in the above Japanese Patent Publication No. 16208/1965. In this example, an integrated spinning ring 1300 consisting of a ring flange portion 1301 and a mount portion 1302 is formed by punching a disk from a band steel with the use of a punching type press device, and pressing the disk with the use of a press and a rotating spindle. The spinning ring 1300 is fitted into a ring holder and mounted to a ring spinning machine.

Also, FIG. 21 shows a spinning ring 1400 described in the above Japanese Patent Publication No. 47768/1994. In this example, a ring flange portion 1401 being slidingly contacted with a ring traveller is formed from ceramics to be provided at an underside thereof with a recess or a stepped portion, and fitted into a ring neck portion 1403 of a ring body 1402, which is formed from carbon steel, light alloy or plastic, to be bonded and fixed by means of an adhesive.

The above-mentioned conventional spinning ring formed from a cylindrical-shaped blank stock by means of cutting work is difficult to obtain accuracy on a ring flange portion adapted to slidingly contact with a ring traveller, and the ring flange portion is not easy to be enhanced in wear resistance while material cost is suppressed. In contrast, in the case of forming a spinning ring from a sheet steel as described in the above Japanese Patent Publication No. 16208/1965 and securing to a ring body a ring flange portion, which is formed from a separate material, as described in the above Japanese Patent Publication No. 47768/1994, it is relatively easy to obtain accuracy on a ring flange portion and to enhance the wear resistance in the ring flange portion.

Since an integrally formed spinning ring as described in the above Japanese Patent Publication No. 16208/1965, however, is complex in manufacturing process itself for automation to lead to high manufacture cost, and formed by bending of a sheet steel such that a ring flange portion for engagement with a ring traveller has a free end at an end of an underside thereof, there is caused a problem that when the ring traveller runs sliding on the ring flange portion, the ring flange portion causes fine vibrations to lead to abnormal vibrations in both the ring traveller and the ring flange portion, resulting in shortening of service life and frequent occurrence of yarn breakage to lower productivity.

Also, in the case of the spinning ring described in the above Japanese Patent Publication No. 47768/1994, in which the ring flange portion adapted to slidingly contact with a ring traveller is formed as a whole from a separate material and fittingly secured to a neck portion on a ring body side, a fitting portion where the ring flange portion and the neck portion fit together is small in contact area, and so there is caused a problem that load or shock applied at the time of mounting and dismounting of a ring traveller and vibrations or shock at the time of running of the ring traveller will release fitting of the ring flange portion and the neck portion to permit the ring flange portion to rotate on the neck portion upon running of a ring traveller and to cause the ring flange portion to separate from the neck portion, resulting in incapability of spinning.

OBJECT AND SUMMARY OF THE INVENTION

The invention has been thought of for the purposes of solving the above-mentioned problem, and has its object to provide a spinning ring, in which a ring flange portion can be enhanced in accuracy and wear resistance, and there is not involved a problem that fine vibrations possibly generated on the ring flange portion at the time of running of a ring traveller cause a ring traveller and the ring flange portion to undergo abnormal wear to be shortened in service life and yarn breakage is frequently generated to decrease productivity, and which is free of rotation of the ring flange portion upon the running of a ring traveller resulted from falling-off of the ring flange portion, which results from load and shock applied at the time of attaching and detaching of the ring traveller and of incapability of spinning caused by falling-off of the ring flange portion, and a method of manufacturing the same.

Based on the knowledge that in a spinning ring comprising a ring flange portion making a track for running of a ring traveller in a sliding contact condition and a mount portion mounted on a ring rail or a ring holder, formation of the spinning ring through fitting and securing of a plurality of members is advantageous in enhancing the ring flange portion in accuracy and wear resistance and that with respect to formation of the spinning ring through fitting and securing of a plurality of members, since dimensional and configurational accuracies are specifically demanded for a running surface of the traveller on an inner peripheral side of the ring flange portion, strength in fitting and securing is easy to ensure when a portion on the inner peripheral side for forming the running surface of the traveller is a separate member or when the portion on the inner peripheral side for forming the running surface of the traveller is a separate member and a portion on an outer peripheral side for forming the running surface of the traveller is formed from a member integral with the mount portion rather than when the entire ring flange portion, the invention provides a spinning ring, in which the ring flange portion is divided into two inner and outer sections, and consists of an inner flange and an outer flange, and the inner flange is fitted onto and secured to an inner peripheral side of the outer flange to be made integral therewith, and a method of manufacturing the same.

Thus the spinning ring according to the invention is one provided with a ring flange portion, which permits a ring traveller to run thereon in a sliding contact condition, the ring flange portion composed of an inner flange and an outer flange, the inner flange being formed with a running surface of the traveller, which is formed by folding back an inner peripheral portion of a doughnut-shaped disk blank toward an outer peripheral side of the blank to be disposed on an folded-back, inner peripheral side of the blank and adapted to slidingly contact with a foot portion of a ring traveller, and with a fitting portion, which is disposed on the outer peripheral side of the blank to fit onto the outer flange, the outer flange being formed integral with a mount portion, which is mounted to a ring rail or a ring holder through a neck portion, and being provided on an inner peripheral side thereof with a fitting portion, which is adapted to be fitted onto the inner flange, and on an outer peripheral side thereof with an engaging portion, which is adapted to engage with the foot portion of the ring traveller, the inner flange and the outer flange fitting together and being integrated together by a securing means.

A doughnut-shaped disk blank making the inner flange is preferably formed by punching a band-shaped or coiled sheet material such as sheet steel, alloy steel sheet or the like, and the outer flange is formed by cutting or rolling from a cylindrical-shaped stock material of iron materials such as carbon steel, alloy steel or the like or nonferrous metal materials such as aluminum, aluminum alloy or the like.

The above-mentioned securing means is of fixed type such as press fit, caulking, shrinkage fit, welding or bonding or of detachable type such as press fit, thread fastening or elastic grasping. Polymerization/condensation type adhesives such as epoxy resin, phenol resin, cyanoacrylate or the like are suitable as an adhesive.

The above-mentioned spinning ring is easily enhanced in dimensional and configurational accuracies and is capable of forming a running surface of the traveller of high accuracy and forming only an inner flange from a.separate material to enhance wear resistance because the ring flange portion is constituted by an inner flange, which is formed by folding an inner peripheral portion of a doughnut-shaped disk blank back toward the outer periphery of the blank and on which a running surface of the traveller is formed, and an outer flange formed integral with a mount portion, and a portion forming the running surface of the traveller on the inner peripheral side, for which dimensional and configurational accuracies are specifically demanded, can be formed from a sheet material, such as sheet steel or the like, by press work or the like, as the inner flange separate from a ring body including the mount portion.

Accordingly, the ring flange portion can be enhanced in accuracy and wear resistance, and moreover there is eliminated a problem that fine vibrations possibly generated on the ring flange portion at the time of running of a ring traveller cause a ring traveller and the ring flange portion to undergo abnormal wear to be shortened in service life and yarn breakage is frequently generated due to abnormal running of the ring traveller, thus decreasing productivity. Also, it is possible to attain an intended object for proving a spinning ring free of rotation of the ring flange portion upon the running of a ring traveller resulted from falling-off of the ring flange portion, which results from load and shock applied at the time of attaching and detaching of the ring traveller and of incapability of spinning caused by falling-off of the ring flange portion. Also, freedom in the fitting construction of an inner flange and an outer flange can make a spinning ring integrated with rigid fitting and securing. Also, in this case, it is desired to fill a synthetic resin adhesive such as epoxy resin, which is a thermosetting resin, in a groove, which is formed on the upper surface of the ring flange portion and has a cross section of, for example, inverse frustum, and thus it is possible to prevent accumulation of foreign matters in the groove and to further strengthen securing of the inner flange and the outer flange.

Also, the spinning ring can be made such that the inner flange is formed with a curved surface of predetermined shape, which is formed by folding back an inner peripheral portion of a doughnut-shaped disk blank toward an outer peripheral side of the blank and bending the inner peripheral portion of the folded-back blank upward and which is disposed on the bent, inner peripheral portion to define a running surface of the traveller. In this case, the running surface of the traveller inside can be made an optional curved surface, and is further enhanced in dimensional and configurational accuracies.

When the doughnut-shaped disk blank in a state, in which the inner peripheral portion of the disk blank folded back is bent further upward, is made a surface, on which a foot portion of a ring traveller is made to run, rather than the case where the doughnut-shaped disk blank in a folded-back state is made a surface, on which a foot portion of a ring traveller is made to run, a curved surface with high dimensional and configurational accuracies can be formed as the surface, on which a foot portion of a ring traveller is made to run.

Also, in this case, in order to prevent accumulation of foreign matters in that groove, which is formed above the fitting portion and has a cross section of, for example, inverse frustum, and to further strengthen securing of the inner flange and the outer flange, a synthetic resin adhesive such as epoxy resin, which is a thermosetting resin, or the like is desirably filled in the groove.

In the spinning ring, the constitution for ensuring a joining surface where the inner flange and the outer flange are fitted and secured to each other and making integration firm is preferably, for example, one, in which the inner flange is constructed such that an upper portion of two overlapping upper and lower portions of the blank thus folded back is larger than a lower portion and an outer peripheral portion is stepped to provide a fitting portion adapted to fit onto the outer flange, the outer flange is constructed such that a part of an upper surface on an inner peripheral side thereof is cut away over an entire circumference, an upper, inner peripheral surface is stepped in shape, and the stepped, upper, inner peripheral surface defines a fitting portion fitted onto the inner flange, and the fitting portion defined by the stepped, outer peripheral portion of the inner flange and the fitting portion defined by the stepped, upper, inner peripheral surface of the outer flange fit together.

In this case, mutual fitting of the stepped fitting portions of the inner flange and the stepped fitting portions of the outer flange strengthens integration of the inner flange and the outer flange caused by fitting and securing of the both.

Also, the constitution for ensuring a joining surface where the inner flange and the outer flange are fitted and secured to each other and making integration firm may be one, in which the inner flange is constructed such that overlapping upper and lower portions of the blank thus folded back has a gap allowing elastic deformation at outer peripheral portions thereof and the elastic, outer peripheral portions defines a fitting portion adapted to fit onto the outer flange, the outer flange is constructed such that a part of an upper surface on an inner peripheral side thereof is cut away over an entire circumference, an upper, inner peripheral surface is stepped in shape, a groove is provided below a cut-away portion of the upper, inner peripheral surface, and the portion provided with the groove defines a fitting portion adapted to fit into the inner flange, and the fitting portion defined by the elastic, outer peripheral portion of the inner flange and the groove below the cut-away portion of the upper, inner peripheral surface of the outer flange fit together.

In this case, the elastic, outer peripheral portion, which constitutes the fitting portion of the inner flange is fitted into and firmly secured to the groove, which constitutes the fitting portion of the outer flange, by means of press fit or shrinkage fit with elastic forces.

Also, the constitution for preventing the inner flange from dismounting from the outer flange is preferably, for example, one, in which the inner flange is constructed such that overlapping upper and lower portions of the blank thus folded back defines a fitting portion adapted to fit onto the outer flange, the outer flange is constructed such that a part of an upper surface on an inner peripheral side thereof is cut away over an entire circumference, an upper, inner peripheral surface is stepped in shape, and the stepped, upper, inner peripheral surface defines a fitting portion fitted onto the inner flange, an outer peripheral surface of an upper portion above the fitting portion of the inner flange and an inner peripheral surface of the cut-away portion of the outer flange opposed to the outer peripheral surface, respectively, are inclined upwardly inwardly at an inclination of 3° to 12°, and the fitting portion defined by the outer peripheral portion of the inner flange and the fitting portion defined by the stepped, upper, inner peripheral surface of the outer flange fit together.

In this manner, the outer peripheral surface of the upper portion on the inner flange and the inner peripheral surface of the cut-away portion of the outer flange, respectively, are inclined at an inclination 3° to 12° upwardly inwardly whereby engagement of the fitting portions can be ensured and be free of disengagement even when securing of the securing measure such as shrinkage fit or the like is loosened. In this case, when the inclination is less than 3°, engagement is insufficient, and when the inclination exceeds 12°, fitting is difficult.

Also, the constitution for ensuring a joining surface where the inner flange and the outer flange are fitted and secured to each other and making integration by adhesion is preferably one, in which the inner flange is constructed such that overlapping upper and lower portions of the blank thus folded back defines a fitting portion adapted to fit onto the outer flange, the outer flange is constructed such that a part of an upper surface on an inner peripheral side thereof is cut away over an entire circumference, an upper, inner peripheral surface is stepped in shape, and the stepped, upper, inner peripheral surface defines a fitting portion fitted onto the inner flange, an outer peripheral surface of an upper portion above the fitting portion of the inner flange and an inner peripheral surface of the cut-away portion of the outer flange opposed to the outer peripheral surface, respectively, are formed to be inclined upwardly inwardly at an inclination of 10° to 15°, a maximum diameter E of the upper portion of the inner flange and a minimum diameter C of the cut-away portion have a relationship $E \leqq C$, and there is formed a space between the fitting portions, and the fitting portion defined by the outer peripheral portion of the inner flange and the fitting portion defined by the stepped, upper, inner peripheral surface of the outer flange fit together, and an adhesive is filled and solidified in the space between the fitting portions. Polymerization/condensation type adhesives such as epoxy resin, phenol resin, cyanoacrylate or the like are suitably used as an adhesive.

In this case, the inner flange and the outer flange are secured integrally to each other by fitting of the stepped fitting portions and solidification of an adhesive filled in the space between the fitting portions, and falling-off of the inner flange is prevented by the wedge action of the adhesive resin as solidified.

The spinning ring according to the invention is simple in its manufacturing process and low in manufacturing cost because the ring flange portion consists of the inner flange and the outer flange and the inner flange can be formed in continuous work from a sheet steel.

A method of manufacturing a spinning ring having an inner flange, in which an inner peripheral portion of a doughnut-shaped plate blank is folded back toward an outer peripheral side and a running surface of the traveller is formed on the inner peripheral side thus folded back to permit a foot portion of a ring traveller to slidingly contact therewith is one, in which the inner flange is formed into a predetermined shape sequentially through the step of punching a thin sheet material to form a circular-shaped disk blank, the burring prepared hole forming step of punching a central portion of the circular-shaped disk blank to form a doughnut-shaped disk blank, the burring step of bending an inner peripheral portion of the doughnut-shaped disk blank upright in a flange manner, the folding-back step of folding back the bent, inner peripheral portion of the doughnut-shaped blank toward an outer periphery of the blank to vertically overlap the same on the outer periphery to form a running surface of the traveller on the inner peripheral portion in the folded-back state, and the trimming step of punching the doughnut-shaped blank, on which the running surface of the traveller is formed through the folding-back step, to a predetermined outer diameter dimension, the outer flange integral with the mount portion is formed integrally from a cylindrical-shaped stock material by cutting or rolling, and the inner flange thus formed is integrally secured to a fitting portion, which is formed on an outer peripheral side of the outer flange, by press fit, shrinkage fit, welding or bonding.

Also, a method of manufacturing a spinning ring having an inner flange, in which an inner peripheral portion of a doughnut-shaped plate blank is folded back toward an outer peripheral side, the folded-back inner peripheral portion is bent upward, and a running surface of the traveller is formed on the bent, inner peripheral side, is one, in which the inner flange is formed into a predetermined shape sequentially through the step of punching a thin sheet material to form a circular-shaped disk blank, the burring prepared hole forming step of punching a central portion of the circular-shaped disk blank to form a doughnut-shaped disk blank, the burring step of bending an inner peripheral portion of the doughnut-shaped disk blank upright in a flange manner, the folding-back step of folding back the bent, inner peripheral portion of the doughnut-shaped blank toward an outer periphery of the blank to vertically overlap the same on the outer periphery, the bending step of bending the folded-back, inner peripheral portion of the blank upward to form a curved surface of predetermined shape, which defines a running surface of the traveller on the bent, inner peripheral portion, and the trimming step of punching the doughnut-shaped blank, on which the running surface of the traveller is formed through the folding-back step, to a predetermined outer diameter dimension, the outer flange integral with the mount portion is formed integrally from a cylindrical-shaped stock material by cutting or rolling, and the inner flange thus formed is integrally secured to a fitting portion, which is formed on an outer peripheral side of the outer flange, by press fit, shrinkage fit, welding or bonding. In this case, it is preferable that a synthetic resin adhesive such as epoxy resin, which is a thermosetting resin, is filled in a groove, which is formed on an upper surface of the ring flange portion and has a cross section of, for example, inverse frustum. By doing so, it is possible to prevent foreign matters from accumulating in the groove and make securing of the inner flange and the outer flange more firm.

In the method of manufacturing a spinning ring, a sheet material making a doughnut-shaped disk blank for an inner flange is preferably a band-shaped or coiled sheet material such as sheet steel, alloy steel sheet or the like, and a cylindrical-shaped stock material for an outer flange is preferably iron materials such as carbon steel, alloy steel or the like or nonferrous metal materials such as aluminum, aluminum alloy or the like. Also, polymerization/condensation type adhesives such as epoxy resin, phenol resin, cyanoacrylate or the like are suitable as an adhesive in the case where securing is effected by adhesion.

The above, and other objects, features and advantages of the invention will become apparent from the following detailed description which is to be read in conjunction with the accompanying drawings.

DESCRIPTION OF THE PREFERRED EMBODIMENT

Embodiments of the invention will be described below with reference to the drawings.

First Embodiment

Figure 1:
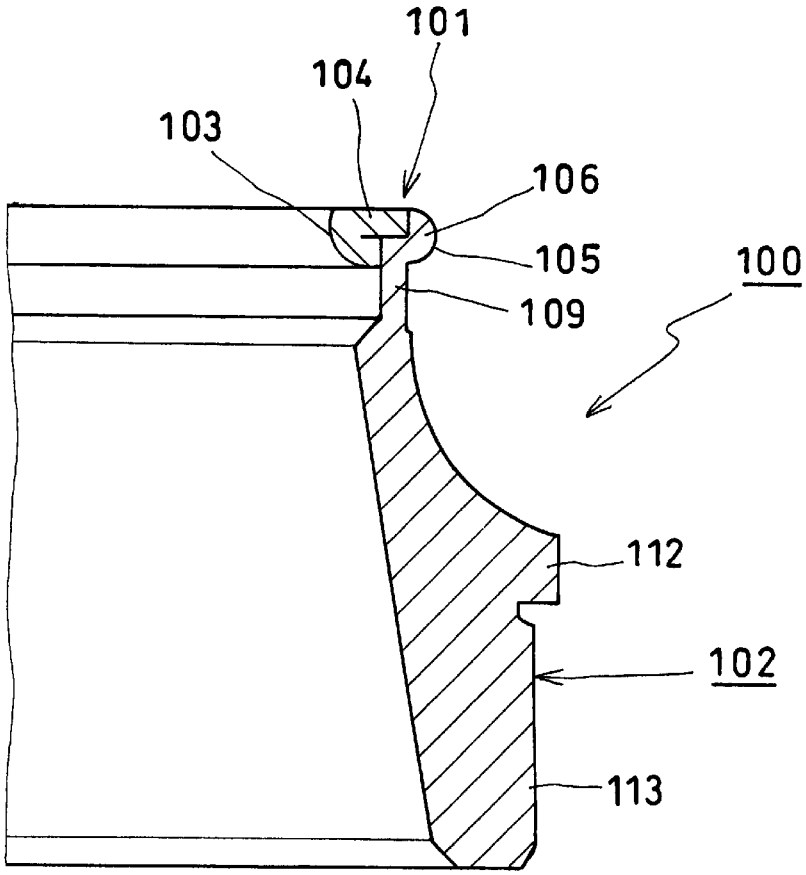
FIG. 1 is a cross sectional view showing a part of a spinning ring according to a first embodiment of the invention.
Figure 2:
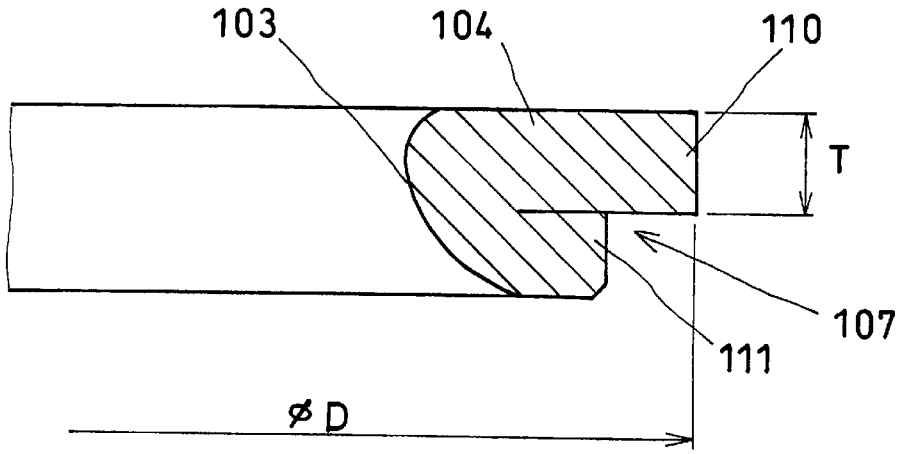
FIG. 2 is a cross sectional view showing a portion of an inner flange of the spinning ring according to the first embodiment of the invention.
Figure 3:
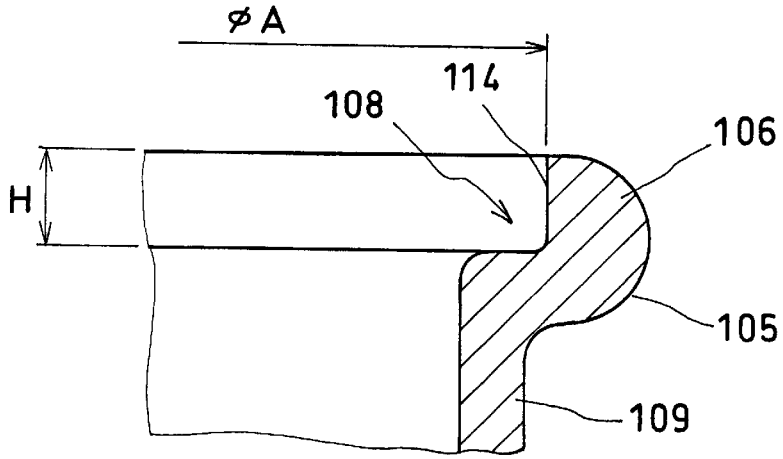
FIG. 3 is a cross sectional view showing a part of an outer flange of the spinning ring according to the first embodiment of the invention.
Figure 4:
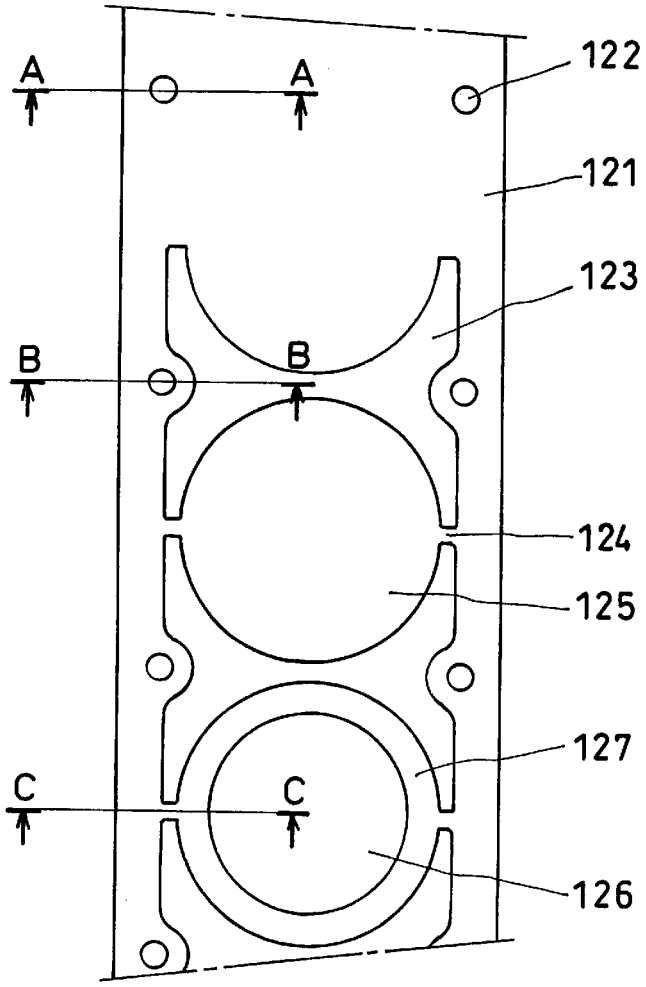
FIG. 4 is a plan view showing a part of a band steel in the blank forming process in manufacture of the inner flange of the spinning ring according to the first embodiment of the invention.
Figure 5:
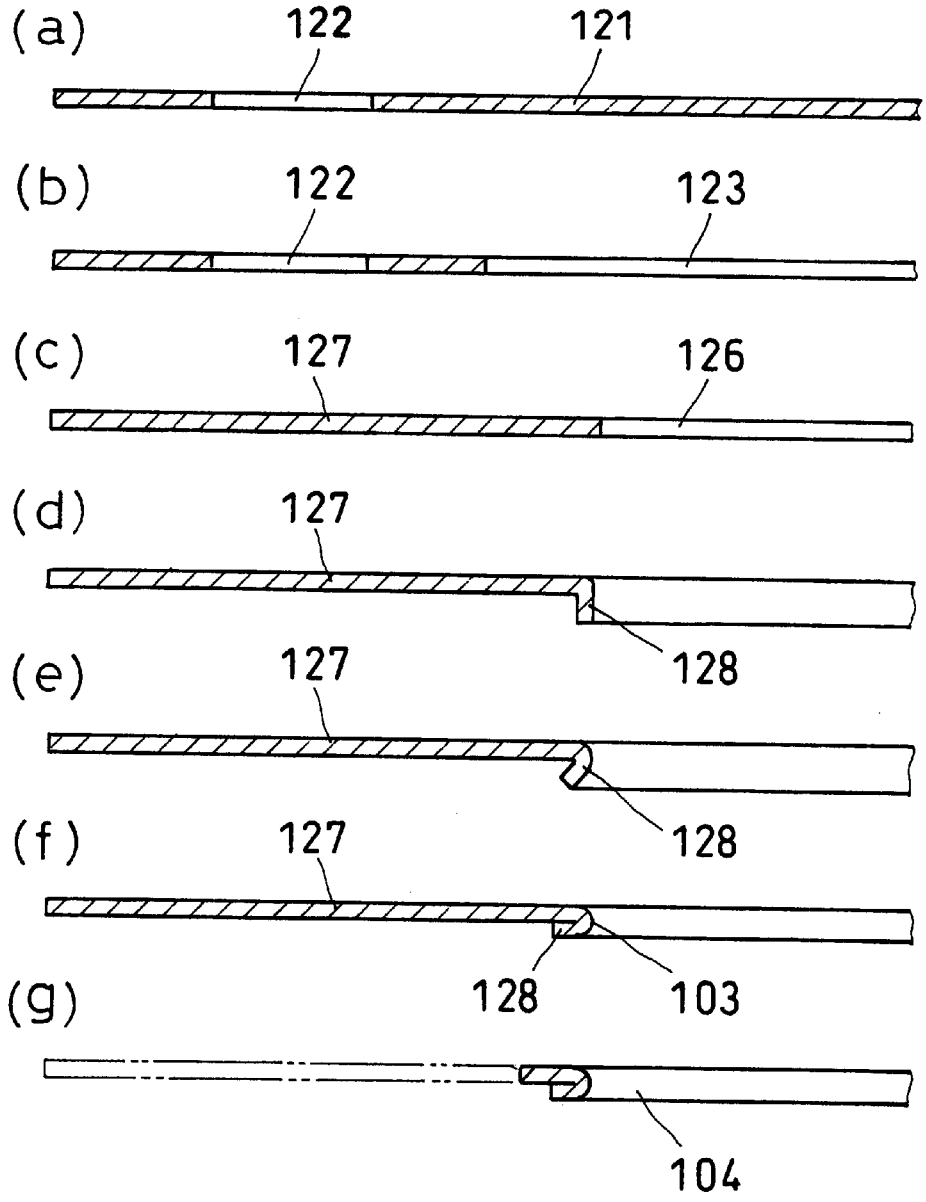
FIG. 5 is cross sectional views A to G showing a part of a band steel in the respective processes in manufacture of the inner flange of the spinning ring according to the first embodiment of the invention.

FIGS. 1 to 5 show a first embodiment of the invention, FIG. 1 being a cross sectional view showing a part of a spinning ring 100, FIG. 2 being a cross sectional view showing a part of an inner flange, FIG. 3 being a cross sectional view showing a part of an outer flange, FIG. 4 being a plan view showing a part of a band steel in the process of formation of a blank in manufacture of an inner flange, and FIG. 5 being cross sectional views A to G showing a part of a band steel in the respective processes in manufacture of the inner flange. FIG. 5A is a cross sectional view taken along the line A—A in FIG. 4, FIG. 5B being a cross sectional view taken along the line B—B, and FIG. 5C being a cross sectional view taken along the line C—C.

As shown in FIG. 1, a spinning ring 100 in this embodiment is provided with a ring flange portion 101 constituting a path, on which a ring traveller is made to run in a state of sliding contact, that is, made to slide, and a mount portion 102 mounted to a ring flange portion 101 mounted to a ring rail.

The ring flange portion 101 is constructed to be divided into an inner flange 104 having a running surface of the traveller 103 in a position disposed about two third of an entire distance toward an outer peripheral side from an inner peripheral side on an upper surface thereof, on which running surface of the traveller 103 an inner foot portion of a ring traveller slides, and an outer flange 106 having an engaging portion 105, with which an outer foot portion of the ring traveller engages.

The inner flange 104 is constructed to be in the form of a torus having a cross section shown in enlarged scale in FIG. 2, and is formed, by press working, from a stock material of a coiled sheet carbon steel, such as cold rolled steel sheet (SPCC), having a thickness of 0.3 mm to 1.0 mm (for example, 0.8 mm) by punching a steel sheet to form a circular-shaped disk blank, further punching the circular-shaped disk blank to form a doughnut-shaped disk blank, folding an inner peripheral portion of the disk blank back outside, forming on its folded-back inner peripheral side the running surface of the traveller 103, on which a foot portion of a ring traveller is made to run and which is defined by a single or plural arcuate surfaces, and trimming the doughnut-shaped disk blank with the running surface of the traveller 103 such that an upper portion 110 of two overlapping upper and lower portions of the blank folded back is larger than a lower portion 111 and has a stepped outer peripheral portion to provide a fitting portion 107 adapted to fit onto the outer flange.

A doughnut-shaped disk blank making the inner flange 104 may be formed by punching a band-shaped or coiled sheet material such as alloy steel sheet or the like in addition to sheet carbon steel.

Also, the outer flange 106 is constructed to be in the form of a torus having a cross section shown in enlarged scale in FIG. 3, and is formed, by cutting or other forming measures such as rolling or the like, from a stock material of a cylindrical-shaped carbon steel material, for example, carbon steel materials (S45C) for machine structural use. The outer flange is constructed such that a part of an upper surface on an inner peripheral side of the outer flange is cut away over an entire circumference, an upper, inner peripheral surface is stepped in shape, the stepped, upper, inner peripheral surface defines a fitting portion 108 fitted onto the inner flange 104, the engaging portion 105 formed by a single or plural arcuate surfaces is provided on an outer peripheral portion of the outer flange to engage with an outer foot portion of a ring traveller, the mount portion 102 having a support flange portion 112 and a fit-in portion 113 on an outer peripheral surface thereof is provided contiguous to the outer flange with a ring neck portion 109 therebetween, the ring neck portion being provided on an inner, lower portion, and the outer flange 106, the ring neck portion 109 and the mount portion 102 are integrally formed.

The fitting portion 108 cut away and formed on the outer flange 106 is constructed to have substantially the same thickness H as a plate thickness T of an upper surface of the inner flange 104, and an inner diameter A on an inner peripheral surface thereof, which is smaller 4/100 to 6/100 mm than an outer diameter D of the upper surface of the inner flange 104.

The outer flange 106 is formed from a cylindrical-shaped stock material of iron materials such as carbon steel, alloy steel or the like or nonferrous metal materials such as aluminum, aluminum alloy or the like, and measures for forming may be rolling in addition to cutting.

Subsequently, the manufacturing process of the inner flange 104 will be described below.

The inner flange 104 is subjected to press working from a band sheet steel 121 with the use of a press machine, such that pilot holes 122 are beforehand formed in the band sheet steel 121, as shown in FIGS. 4 and 5A, in the pilot hole forming step, and the band sheet steel 121 is intermittently moved in a longitudinal direction while positioned in accordance with the pilot holes 122.

Thereafter, a punched hole 123 is formed, as shown in FIGS. 4 and 5B, by hourglass punching in the punching step to form the disk blank 125 of a desired. diameter in the band sheet steel 121 with bridges 124 left.

And punching is performed, as shown in FIGS. 4 and 5C, in the burring prepared hole forming step to form a circular-shaped punched hole 126 in a central portion of a disk blank 125, and form a doughnut-shaped disk blank 127 having a desired widthwise dimension.

In the burring step, an inner peripheral portion 128 of the doughnut-shaped disk blank 127 is bent 90 degrees downward, as shown in FIG. 5D, by burring work to provide a bent, upright configuration.

In the first bending step, the inner peripheral portion 128 of the doughnut-shaped disk blank 127 thus bent upright is further bent 45 degrees as shown in FIG. 5E.

In the second bending step, further bending is carried out, as shown in FIG. 5F, to further bend the inner peripheral portion 128 of the doughnut-shaped disk blank 127 to overlap the same on an outer portion, preferably, contact the same with the outer portion, in a configuration, in which the inner peripheral portion is folded back toward an outer periphery of the doughnut-shaped disk blank 127, so as to form the running surface of the traveller 103 defined by a desired arcuate surface, on the inner peripheral portion in the folded-back state.

Finally, in the trimming step, the blank is punched, as shown in FIG. 5G, into a desired external dimension to form the inner flange 104.

The inner flange 104 thus formed is suitably subjected to surface treatment such as plating treatment, for example, chrome plating, nickel-phosphor plating or the like, carburization hardening, carbo-nitriding, diffusion of metal carbide, surface hardening treatment such as PVD, CVD or the like.

Also, the outer flange 106 is formed from a cylindrical-shaped stock material of carbon steel as described above by the cutting work to be made integral with the ring neck portion 109 and the mount portion 102.

And a high-frequency heating device is used to heat the outer flange 106 to diametrically expand the fitting portion 108, and the fitting portion 107 of the inner flange 104 is fitted into the fitting portion 108 thus expanded in diameter and then cooled to perform shrinkage fit of the upper portion 110 of the inner flange 104 on the upper, inner peripheral portion 114 on the upper portion of the outer flange 106 to integrally secure the both.

In this case, the stepped fitting portion 107 of the inner flange 104 is fitted mutually into the stepped fitting portion 108 of the outer flange 106, whereby fitting and securing of the inner flange 104 and the outer flange 106 have the both united more rigidly.

Measures for securing the fitting portion 107 on the inner flange 104 and the fitting portion 108 on the outer flange 106 to each other while the both are in a fitted state may be press fit, welding, bonding or the like as well as shrinkage fit. In the case of bonding, polymerization/condensation type adhesives such as epoxy resin, phenol resin, cyanoacrylate or the like are suitably used as an adhesive.

Also, an example shown in FIG. 1 is of the type that the mount portion 102 of the spinning ring 100 is mounted directly on a ring rail but may be a spinning ring of the type mounted on a ring holder.

The spinning ring 100 thus formed is easily made high in dimensional and configurational accuracies because a portion forming the running surface of the traveller 103 on the inner peripheral side, for which dimensional and configurational accuracies are specifically demanded, is constituted by the inner flange 104 as a single body formed from a sheet steel. Thus the running surface of the traveller 103 having a high accuracy can be formed, and the inner flange 104 is also formed, as described above, from a sheet blank of carbon steel material or the like and suitably subjected to surface hardening treatment to enable improving abrasion resistance of the running surface of the traveller 103 and the like.

Since the inner flange 104 and the outer flange 106 are firmly secured to each other by, for example, shrinkage fit between the peripheral surface of the upper portion 110 of the inner flange 104 and the upper, inner peripheral portion 114 of the upper portion of the outer flange 106, the inner flange 104 is free of falling off due to a shock, and so free of rotation on the outer flange 106 upon rotation of a ring traveller or separation from the outer flange 106, which would result in incapability of spinning. Also, since the inner flange 104 and the outer flange 106 are integrally secured to each other at the fitting portion 107, fitting portion 108, fine vibrations will not generate on the ring flange portion 101 even upon running of a ring traveller on the running surface of the traveller 103, so that the ring traveller runs smoothly. Therefore, there is eliminated a problem that a ring traveller or a ring undergoes abnormal wear to be shortened in service life and yarn breakage due to abnormal running of the ring traveller is frequently generated to decrease productivity.

A modification of the first embodiment will be described below.

Figure 6:
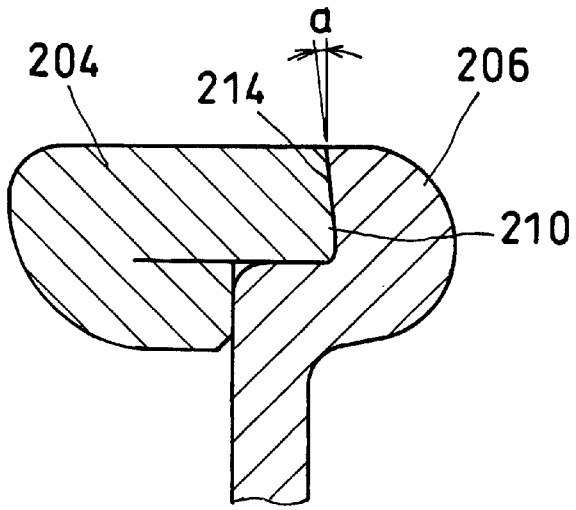
FIG. 6 is an end view showing a ring flange portion of a spinning ring in a modification of the first embodiment of the invention.

FIG. 6 is an end view showing a ring flange portion of a spinning ring according to the modification of the first embodiment of the invention.

With the spinning ring 100 shown in FIG. 1, an outer peripheral surface of the upper portion 110 on the inner flange 104 and the upper, inner peripheral surface 114 of the fitting portion 108 of the outer flange 106 opposed to the outer peripheral surface, respectively, are formed to be substantially vertical, while in the example shown in FIG. 6 an outer peripheral surface of an upper portion 210 on an inner flange 204 and an inner peripheral surface 214 of a cut-away portion above a fitting portion 208 of an outer flange 206 opposed to the outer peripheral surface are inclined at an inclination $\alpha$ upwardly inwardly relative to a vertical.

The above-mentioned inclination $\alpha$ is suitably 3 ° to 12°. The remainder of the arrangement is the same as that of the spinning ring 100, and a manufacturing method is also the same as that of the spinning ring 100.

Thus, since the outer peripheral surface of the upper portion 210 on the fitting portion of the inner flange 204 and the inner peripheral surface 214 of the cut-away portion above the fitting portion of the outer flange 206, respectively, are inclined at an inclination 3° to 12° upwardly inwardly, engagement of the fitting portions is ensured even when securing produced by securing means such as shrinkage fit or the like becomes loose, and so falling-off can be prevented. When the inclination $\alpha$ is less than 3°, engagement is insufficient, and when the inclination exceeds 12°, fitting is difficult.

Figure 7:
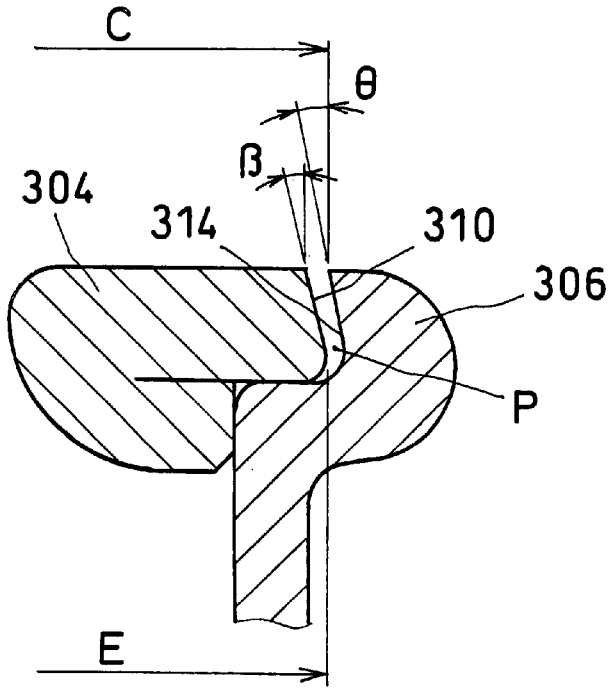
FIG. 7 is an end view showing a ring flange portion of a spinning ring in another modification of the first embodiment of the invention.

FIG. 7 is an end view showing a ring flange portion of a spinning ring according to another modification of the first embodiment of the invention.

With the spinning ring 100 shown in FIG. 1, measures for securing the fitting portion 107 of the inner flange 104 and the fitting portion 108 of the outer flange 106 to each other while the both are in a fitted state include shrinkage fit, press fit, welding, bonding or the like. In the case of bonding, the outer peripheral surface of the upper portion 110 on the inner flange 104 and the upper, inner peripheral surface 114 of the fitting portion 108 of the outer flange 106 opposed to the outer peripheral surface are bonded to each other in a substantially closely contacted position. Also, while the modification shown in FIG. 6 is the same as shown in FIG. 1 except that joining surfaces are inclined, a spinning ring shown in FIG. 7 is constructed such that an outer peripheral surface of an upper portion 310 on a fitting portion of an inner flange 304 is inclined at an inclination $\beta$ upwardly inwardly relative to a vertical, an inner peripheral surface 314 of a cut-away portion above a fitting portion of an outer flange 306 opposed to the outer peripheral surface is inclined at an inclination $\theta$ upwardly inwardly relative to a vertical, a maximum diameter E of the upper portion 310 of the inner flange 304 and a minimum diameter C of the inner peripheral surface 314 of the outer flange 306 are put in a relationship $E \leqq C$, and there is produced a space P between the outer peripheral surface of the upper portion 310 of the inner flange 304 and the inner peripheral surface 314 of the cut portion of the outer flange 306 when the inner flange 304 is fitted onto the outer flange 306.

And a thermosetting resin adhesive, for example, epoxy-based resin, is filled in the space P and solidified whereby the inner flange 304 and the outer flange 306 are integrally secured to each other. Polymerization/condensation type adhesives such as phenol resin, cyanoacrylate or the like as well as epoxy resin are suitable as an adhesive.

The above-mentioned inclinations $\beta$ and $\theta$, respectively, are suitably 10° to 15°. The remainder of the arrangement is the same as that of the spinning ring 100 shown in FIG. 1.

In this case, a resin filled and solidified in the inclined space P between the inner flange 304 and the outer flange 306 provides a wedge action to prevent the inner flange 304 from falling off.

While the inclinations $\beta$ and $\theta$, respectively, are suitably 10° to 15°, the inclination $\beta \geqq$ the inclination $\theta$ is preferable, which facilitates the filling operation of the resin. Also, with the inclinations $\beta$ and $\theta$ being less than 10°, engagement of the inner flange 304 and the outer flange 306 caused by the wedge action of the resin becomes insufficient, and when 15° is exceeded, the space P defined between the inner flange 304 and the outer flange 306 becomes larger than desired, which leads to a large amount of the resin filled in the space P to result in an increase in cost and cause a difficulty in working of the inner peripheral surface 314 of the outer flange 306.

Second Embodiment

Figure 8:
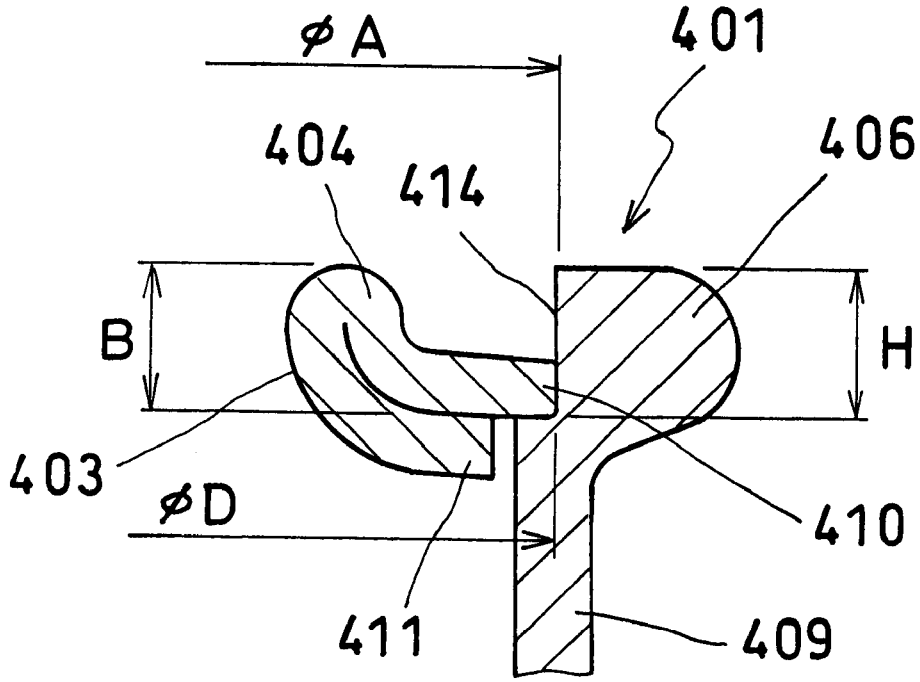
FIG. 8 is an end view showing a ring flange portion of a spinning ring according to a second embodiment of the invention.
Figure 9:
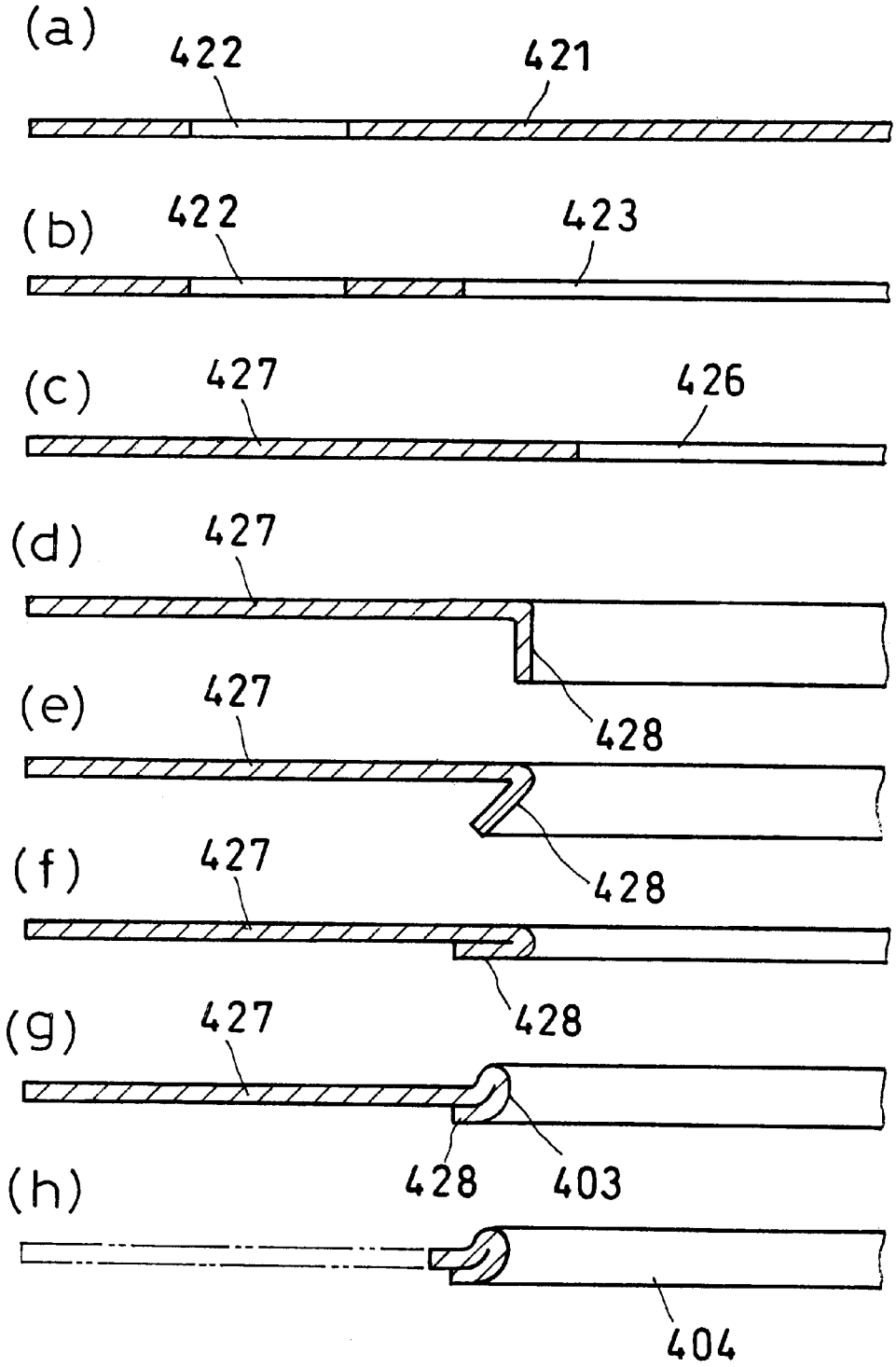
FIG. 9 is cross sectional views A to H showing a part of a band steel in the respective processes in manufacture of an inner flange of the spinning ring according to the second embodiment of the invention.

FIG. 8 is an end view showing a ring flange portion of a spinning ring according to a second embodiment of the invention, and FIG. 9 is cross sectional views A to H showing a part of a band steel in the respective processes in manufacture of an inner flange of the spinning ring.

With the second embodiment, an inner flange 404 or an inner peripheral portion of a doughnut-shaped disk blank is folded back outside as shown in FIG. 8, and an inner peripheral portion of the blank thus folded back is bent upward to form a running surface of the traveller 403, which is defined by a predetermined curved surface, on an inner peripheral side thus folded back.

In this case, like the first embodiment, a ring flange portion 401 is divided into the inner flange 404 and an outer flange 406, and the outer flange 406 is formed integral with a mount portion (not shown) with a ring neck portion 409 therebetween.

The inner flange 404 is formed, by press working, from a stock material of a sheet carbon steel (a material of which is the same as that in the first embodiment) having a thickness of, for example, 0.4 mm by punching a steel sheet to form a circular-shaped disk blank, further punching the circular-shaped disk blank to form a doughnut-shaped disk blank, folding an inner peripheral portion of the disk blank back outside, bending an folded-back, inner peripheral portion of the blank upward to form the running surface of the traveller 403, on a bent, inner peripheral side of which a foot portion of a ring traveller is made to slide and which is defined by a single or plural arcuate surfaces, and trimming the doughnut-shaped disk blank formed with the running surface of the traveller 403 such that an upper portion 410 of two overlapping upper and lower portions of the blank thus folded back is larger than a lower portion 411 and has a stepped outer peripheral portion to provide a fitting portion adapted to fit on the outer flange 406. A gap is defined between the lower portion 411 of the fitting portion on the inner flange 404 and a lower, inner peripheral surface of the fitting portion on the outer flange 406.

Also, the outer flange 406 is constructed, as shown in FIG. 8, such that a height H of an inner peripheral portion 414 at a notch on the fitting portion is substantially the same as a height B from an underside of the upper portion 410 of the fitting portion on the inner flange 404 to a topmost portion of the running surface of the traveller 403 and an inner diameter A of the inner peripheral portion 414 is substantially the same as or preferably smaller 4/100 to 6/100 mm than an outer diameter of the upper surface of the inner flange 404.

As in the first embodiment, the outer flange 406 is formed by cutting, rolling or the like from a cylindrical-shaped stock material of iron materials such as carbon steel, alloy steel or the like or nonferrous metal materials such as aluminum, aluminum alloy or the like.

The manufacturing process of the inner flange 404 in the second embodiment will be described below.

The inner flange 404 is subjected to press working from a band sheet steel 421 with the use of a press machine, such that pilot holes 422 are beforehand formed in the band sheet steel 421, as shown in FIG. 9A, in the pilot hole forming step, and the band sheet steel 421 is intermittently moved in a longitudinal direction while positioned in accordance with the pilot holes 422.

Thereafter, a punched hole 423 is formed, as shown in FIG. 9B, by hourglass punching in the punching step to form a disk blank of a desired diameter in the band sheet steel 421 with bridges left.

And punching is performed, as shown in FIG. 9C, in the burring prepared hole forming step to form a circular-shaped punched hole 426 in a central portion of the disk blank, and form a doughnut-shaped disk blank 427 having a desired widthwise dimension.

In the burring step, an inner peripheral portion 428 of the doughnut-shaped disk-blank 427 is bent 90 degrees downward, as shown in FIG. 9D, by burring work to provide a bent, upright configuration.

In the first bending step, the inner peripheral portion 428 of the doughnut-shaped disk blank 427 thus bent upright is further bent 45 degrees as shown in FIG. 9E.

In the second bending step, further bending is carried out, as shown in FIG. 9F, to further bend the inner peripheral portion 428 of the doughnut-shaped disk blank 427 to overlap the same on an outer portion, preferably, contact the same with the outer portion, in a configuration, in which the inner peripheral portion is folded back toward an outer periphery of the doughnut-shaped disk blank 427.

In the bending step, the inner peripheral portion thus folded back is further bent upward, as shown in FIG. 9G, to form a running surface of the traveller 403 defined by a desired arcuate surface on an inner peripheral side thus bent.

Finally, in the trimming step, the blank is punched, as shown in FIG. 9H, into a desired external dimension to form an inner flange 404.

The inner flange 404 thus formed is suitably subjected to surface treatment such as plating treatment, for example, chrome plating, nickel-phosphor plating or the like, carburization hardening, carbo-nitriding, diffusion of metal carbide, surface hardening treatment such as PVD, CVD or the like.

With the second embodiment, the mount portion on the spinning ring may be of the type mounted directly on a ring rail or of the type mounted on a ring holder.

The outer flange 406 is formed from a cylindrical-shaped stock material of carbon steel as described above by the cutting work to be made integral with the ring neck portion 409 and the mount portion, for example, a high-frequency heating device heats the outer flange 406 to diametrically expand the cut inner peripheral portion 414 on the fitting portion, and the upper portion 410 on the fitting portion of the inner flange 404 is fitted into the inner peripheral portion 414 thus expanded in diameter and then cooled to perform shrinkage fit of the upper portion 410 of the inner flange 404 on the inner peripheral portion 414 on the upper portion of the outer flange 406 to integrally secure the both.

In this case, the upper portion 410 on the fitting portion of the inner flange 404 is fitted mutually into the cut inner peripheral portion 414 on the stepped fitting portion of the outer flange 406, whereby fitting and securing of the inner flange 404 and the outer flange 406 have the both united more rigidly.

Measures for securing the upper portion 410 on the fitting portion of the inner flange 404 and the inner peripheral portion 414 on the fitting portion of the outer flange 406 to each other while the both are in a fitted state may be press fit, welding, bonding or the like as well as shrinkage fit. In the case of bonding, polymerization/condensation type adhesives such as epoxy resin, phenol resin, cyanoacrylate or the like are suitably used as an adhesive.

The spinning ring 100 in the second embodiment is easily made high in dimensional and configurational accuracies in the same manner as in the first embodiment because a portion forming the running surface of the traveller 403 on the inner peripheral side, for which dimensional and configurational accuracies are specifically demanded, is constituted by the inner flange 404 as a single body formed from a sheet steel. In particular, the inner flange 404 is designed such that the inner peripheral portion of the doughnut-shaped disk blank 427 is folded back toward the outer periphery of the blank, and the inner peripheral portion of the doughnut-shaped disk blank thus folded back is bent upward to form a curved surface, which makes the running surface of the traveller 403, on the inner peripheral portion side thus bent, and so accuracy for the curved surface is easily obtained at the time of bending, so that the running surface of the traveller 403 is enhanced in dimensional and configurational accuracies. In addition, the inner flange 404 can be made as small as about a half, for example, 0.4 mm of that in the first embodiment shown in FIG. 1, whereby it is possible to make the ring lightweight, and the forming work is further facilitated to enable forming a curved surface for the running surface of the traveller 403.

In the example shown in FIG. 8, a gap is defined between the lower portion 411 on the fitting portion of the inner flange 404 and an inner peripheral surface of a lower portion of the fitting portion of the outer flange 406, but an arrangement without such gap in this area can be made.

Also, the running surface of the traveller 403 or the like can be improved in abrasion resistance by forming the inner flange 404 from a sheet blank of stock material such carbon sheet steel or the like and suitably subjecting the same to surface hardening treatment as described above.

Since the inner flange 404 and the outer flange 406 are firmly secured to each other by, for example, shrinkage fit between the peripheral surface of the upper portion 410 of the inner flange 404 and the inner peripheral portion 414 of the upper portion of the outer flange 406, the inner flange 404 is free of falling off due to a shock, and so free of rotation on the outer flange 406 upon rotation of a ring traveller or separation from the outer flange 406, which would result in incapability of spinning. Also, since the inner flange 404 and the outer flange 406 are integrally secured to each other between the peripheral surface of the upper portion 410 of the inner flange 404 and the inner peripheral portion 414 of the upper portion of the outer flange 406, fine vibrations will not generate on the ring flange portion 401 even upon running of a ring traveller on the running surface of the traveller 403, so that the ring traveller runs smoothly. Therefore, there is eliminated a problem that a ring traveller or a ring undergoes abnormal wear to be shortened in service life and yarn breakage due to abnormal running of the ring traveller is frequently generated to decrease productivity.

Figure 10:
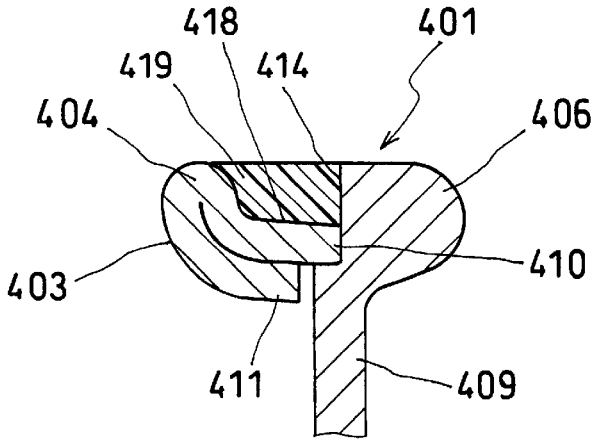
FIG. 10 is an end view showing a ring flange portion of a spinning ring according to a modification of the second embodiment of the invention.

FIG. 10 is an end view showing a ring flange portion of a spinning ring according to a modification of the second embodiment of the invention.

With the second embodiment, an upper surface of the ring flange portion 401 is not planar as shown in FIG. 8. With a spinning ring shown in FIG. 10, a synthetic resin adhesive 419 such as epoxy resin, which is a thermosetting resin, phenol resin, or the like is filled and solidified in a groove 418 having a cross section of inverse frustum and formed above a fitting portion, to which the inner flange 404 and the outer flange 406 are fitted and secured, so that an upper surface of the ring flange portion 401 is made planar. In this manner, foreign matters can be prevented from accumulating in the groove 418, and besides the inner flange 404 and the outer flange 406 are firmly secured to each other.

Like the modification of the first embodiment shown in FIG. 6, a modification of the second embodiment is constructed such that an outer peripheral surface of the upper portion 410 on the fitting portion of the inner flange 404 and the inner peripheral surface 414 on the upper cut portion of the outer flange 406 facing the outer peripheral surface are inclined at an inclination of, for example, 3° to 12° upwardly inwardly relative to a vertical.

Also, like the modification of the first embodiment shown in FIG. 7, a construction can be such that an outer peripheral surface of the upper portion 410 on the fitting portion of the inner flange 404 and the inner peripheral surface 414 on the upper cut portion of the outer flange 406, respectively, are inclined at an inclination of, for example, 10° to 15° upwardly inwardly relative to a vertical, a maximum diameter of the upper portion 410 of the inner flange 404 is equal to or less than a minimum diameter of the inner peripheral surface 414 on the upper cut portion of the outer flange 406, there is produced a space between the outer peripheral surface of the upper portion 410 of the inner flange 404 and the inner peripheral surface 414 on the upper cut portion of the outer flange 406 when the inner flange 404 is fitted onto the outer flange 406, a thermosetting resin adhesive, for example, epoxy-based resin is filled and solidified into the space, and thereby the inner flange 404 and the outer flange 406 are integrally secured to each other. In this case, it is effective in positioning of the inner flange 404 and the outer flange 406 to closely contact the lower portion 411 on the fitting portion of the inner flange 404 and the inner peripheral surface 414 on the lower cut portion of the outer flange 406 with each other.

Also, while in the spinning ring in the second embodiment the fitting portion of the inner flange 404 is formed to be stepped, it may be constructed such that the upper portion 410 and the lower portion 411 be the same in outer diameter to be fitted onto the inner peripheral surface 414 on the cut fitting portion of the outer flange 406.

Third Embodiment

Figure 11:
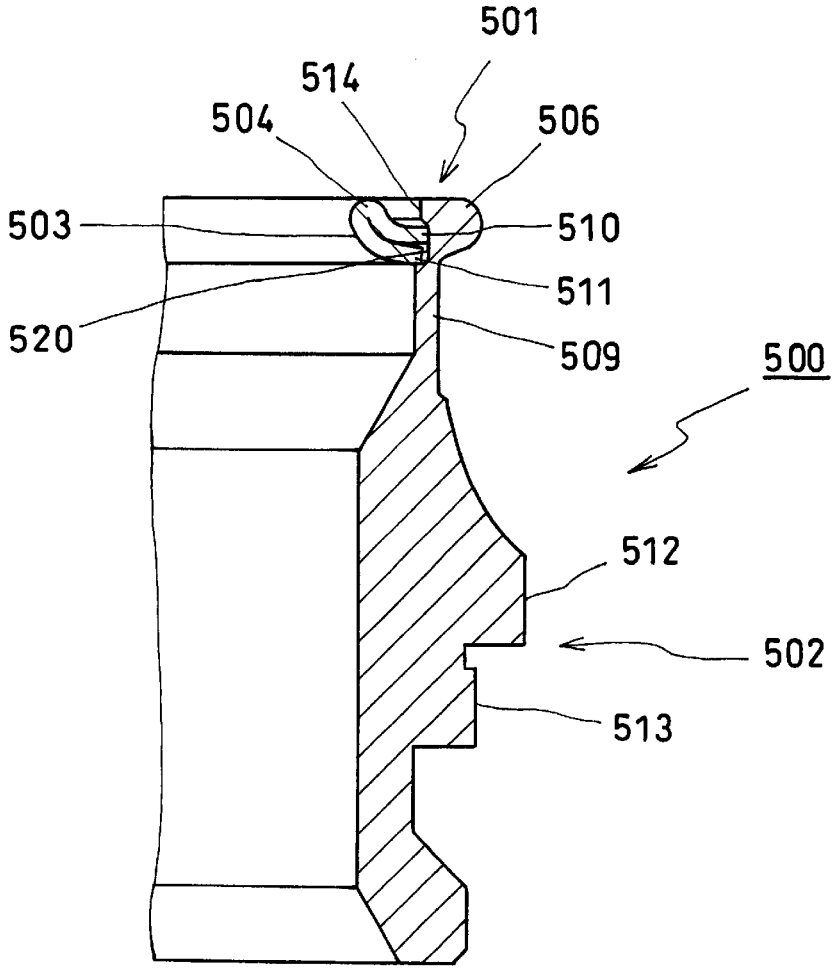
FIG. 11 is a cross sectional view showing a part of a spinning ring according to a third embodiment of the invention.

FIG. 11 is a cross sectional view showing a part of a spinning ring according to a third embodiment of the invention.

With the third embodiment, an inner flange 504 or an inner peripheral portion of a doughnut-shaped disk blank is folded back outside as shown in FIG. 11, and an inner peripheral portion of the blank thus folded back is bent upward to form a running surface of the traveller 503, which is defined by a predetermined curved surface, on an inner peripheral side thus folded back, and an upper portion 510 and a lower portion 511 of the blank thus folded, the portions 510 and 511 being overlapped, posses a gap allowing elastic deformation at outer peripheral portions thereof. The elastic, outer peripheral portions constitute a fitting portion adapted to fit on an outer flange 406, the outer flange 506 being cut away over an entire circumference on a part on an inner peripheral side of an upper surface to make an inner peripheral surface of an upper portion stepped, there being provided a groove 520 over an entire circumference below a cut-away portion 514 of an upper, inner peripheral surface of the outer flange 506, a portion, in which the groove 520 is provided, constituting a fitting portion adapted to fit on the inner flange, and the fitting portion constituted by the upper portion 510 and the lower portion 511 of the inner flange 504 and having elasticity is adapted to fit on a fitting portion constituted by the groove 520 below the cut-away portion 514 on the upper, inner peripheral surface of the outer flange 506.

In this case, like the first embodiment and the second embodiment, a ring flange portion 501 is divided into the inner flange 504 and an outer flange 506, and the outer flange 506 is formed integral with a mount portion 502 with a ring neck portion 509 therebetween, the mount portion 502 being mounted to a ring rail or a ring holder.

Like the second embodiment, the inner flange 504 is formed, by press working, from a stock material of a steel sheet (a material of which is the same as that in the first embodiment) having a thickness of, for example, 0.4 mm by punching a steel sheet to form a circular-shaped disk blank, further punching the circular-shaped disk blank to form a doughnut-shaped disk blank, folding back an inner peripheral portion of the disk blank, bending an folded-back, inner peripheral portion of the blank upward to form the running surface of the traveller 503, on a bent, inner peripheral side of which a foot portion of a ring traveller is made to slide and which is defined by a single or plural arcuate surfaces, and to provide a gap enabling the overlapped, upper portion 510 and lower portion 511 of the blank thus bent to perform elastic deformation on outer peripheral sides thereof, and trimming the doughnut-shaped disk blank formed with the running surface of the traveller 503 such that the upper portion 510 of two overlapping upper and lower portions of the blank thus bent back is larger than the lower portion 511 and has a gap enabling the upper portion 510 and the lower portion 511 to perform elastic deformation on the outer peripheral sides thereof, and the outer peripheral portion, which is stepped and has elasticity, constitutes a fitting portion adapted to fit on the outer flange 506.

Also, as in the first embodiment, the outer flange 506 is formed by cutting, rolling or the like from a cylindrical-shaped stock material of iron materials such as carbon steel, alloy steel or the like or nonferrous metal materials such as aluminum, aluminum alloy or the like.

The inner flange 504 in the third embodiment is subjected to press working from a band sheet steel 421 with the use of a press machine in the same manner as the inner flange 404 in the second embodiment, and thus formed in a desired configuration and dimensions sequentially through the pilot hole forming step, punching step, burring prepared hole forming step, burring step, first bending step, second bending step, bending step and the trimming step.

The inner flange 504 thus formed is suitably subjected to surface treatment such as plating treatment, for example, chrome plating, nickel-phosphor plating or the like, carburization hardening, carbo-nitriding, diffusion of metal carbide, surface hardening treatment such as PVD, CVD or the like.

The outer flange 506 is formed from a cylindrical-shaped stock material of carbon steel as described above by the cutting work to form the ring neck portion 509 and the mount portion 502 integrally as a ring body. At least the outer flange 506 of the ring body is suitably subjected to the same surface treatment as desired.

The fitting portion consisting of the upper portion 510 and the lower portion 511 of the inner flange 504 and having an elastic property is press fitted into the groove 520 on the cut-away portion 514 of the outer flange 506 to be secured thereto elastically and integrally.

In this case, an upper, outer peripheral end of the upper portion 510 of the inner flange 504 is brought into contact with an upper, inclined surface of the groove 520 and a lower, outer peripheral end of the lower portion 511 is brought into contact with a lower surface of the groove 520, whereby the fitting portion of the inner flange 504 consisting of the upper portion 510 and the lower portion 511 is surely secured in the groove 520 thanks to its elasticity.

Measures for fitting the fitting portion of the inner flange 504 into the groove 520 on the cut-away portion 514 of the cut-away fitting portion of the outer flange 506 may be shrinkage fit as well as press fit. Also, an example shown in FIG. 11 is of the type that the mount portion 502 of a spinning ring 500 having a support flange portion 512 and a fit-in portion 513 on an outer periphery thereof is of the type mounted directly on a ring rail but may be a fitting portion of the type mounted on a ring holder.

The spinning ring 100 in the third embodiment is easily made high in dimensional and configurational accuracies in the same manner as in the first embodiment because a portion forming the running surface of the traveller 503 on the inner peripheral side, for which dimensional and configurational accuracies are specifically demanded, is constituted by the inner flange 504 as a single body. In particular, the inner flange 504 is designed such that the inner peripheral portion of the doughnut-shaped disk blank is folded back toward the outer periphery of the blank, and the inner peripheral portion of the blank thus folded back is bent upward to form a curved surface, which makes the running surface of the traveller 503, on the inner peripheral portion side thus bent, and so accuracy for the curved surface is easily obtained at the time of bending, so that the running surface of the traveller 503 is enhanced in dimensional and configurational accuracies. In addition, the inner flange 504 can be made as small as about a half, for example, 0.4 mm of that in the first embodiment shown in FIG. 1, whereby it is possible to make the ring lightweight, and the forming work is further facilitated to enable forming a curved surface for the running surface of the traveller 503.

Also, the inner flange 504 is formed, as described above, from a sheet blank of carbon steel material or the like and suitably subjected to surface hardening treatment to enable improving abrasion resistance of the running surface of the traveller 503 and the like.

Since the inner flange 504 and the outer flange 506 are such that the fitting portion consisting of the upper portion 510 and the lower portion 511 of the inner flange 504 is surely secured in the groove 520 of the outer flange 506 with an elastic force, the inner flange 504 is free of falling off due to a shock, and so free of rotation on the outer flange 506 upon rotation of a ring traveller or separation from the outer flange 506, which would result in incapability of spinning. Also, fine vibrations will not generate on the ring flange portion 501 even upon running of a ring traveller on the running surface of the traveller 503, so that the ring traveller runs smoothly. Therefore, there is eliminated a problem that a ring traveller or a ring undergoes abnormal wear to be shortened in service life and yarn breakage due to abnormal running of a ring traveller is frequently generated to decrease productivity.

Another modification of the third embodiment is constructed in the same manner as the modification of the second embodiment shown in FIG. 10 such that a synthetic resin adhesive such as epoxy resin, which is a thermosetting resin, phenol resin, or the like is filled and solidified in a groove having a cross section of inverse frustum and formed above a fitting portion, to which the inner flange 504 and the outer flange 506 are fitted and secured, so that an upper surface of the ring flange portion 501 can be made planar. In this manner, foreign matters can be prevented from accumulating in the groove, and besides the inner flange 504 and the outer flange 506 are more firmly secured to each other.

Other Embodiments

Figure 12:
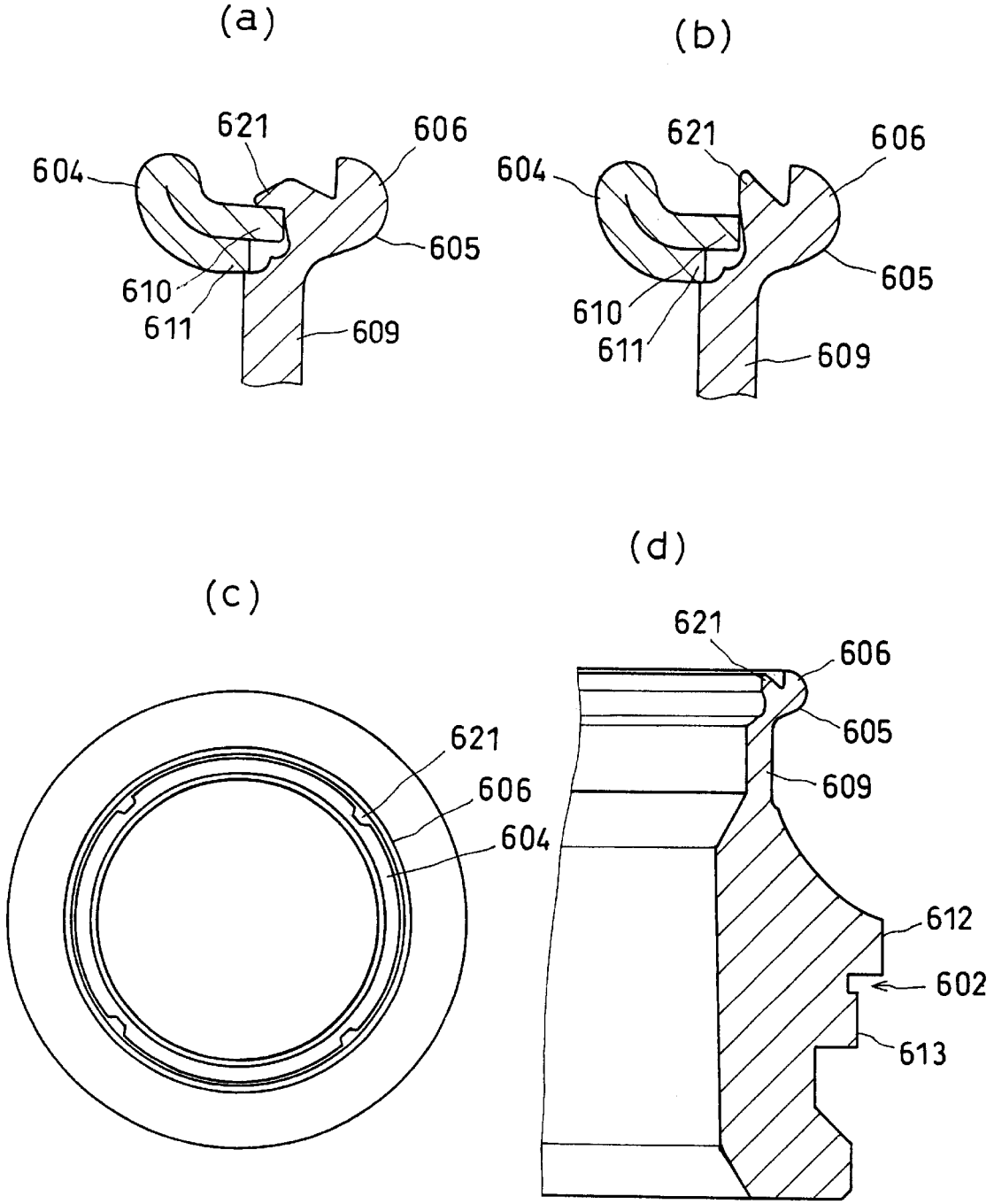
FIG. 12 is an end view A showing a ring flange portion of a spinning ring according to a further embodiment of the invention, an end view B showing the ring flange portion prior to caulking, a plan view C showing the entire spinning ring, and a cross sectional view D showing a part of an outer flange.

It will be appreciated that modifications may be made in out invention. For example, a spinning ring shown in FIG. 12 is constructed such that an inner flange 604 is fixed by caulking, a part of an upper surface on an inner peripheral side of an outer flange 606 is cut away over an entire circumference, an upper, inner peripheral surface of the outer flange is stepped in shape, the stepped, inner peripheral surface defines a fitting portion adapted to be fitted onto a fitting portion of the inner flange 604, ridges 621 are provided above the fitting portion of the outer flange 606 to caulk and fix an upper surface of the fitting portion of the inner flange 604, there is provided on an outer periphery of the outer flange an engaging portion 605, which engages with an outer foot portion of a ring traveller and is defined by a single or plural arcuate surfaces, and a mount portion 602 having a support flange portion 612 and a fit-in portion 613 on an outer peripheral surface thereof is provided contiguous to the outer flange with a ring neck portion 609 therebetween, the ring neck portion 609 being provided on an inner, lower portion of the outer flange. The outer flange 606, the ring neck portion 609 and the mount portion 602 are integrally formed.

The inner flange 604 is constructed such that a fitting portion consisting of two upper and lower portions 610, 611 overlapped on one another in a stepped manner is fitted into the fitting portion of the outer flange 606, and the ridges 621 provided above the fitting portion of the outer flange 606 is then caulked to press down the portion 610 of the fitting portion of the inner flange 604 to fix the fitting portion of the outer flange 606 integrally on the fitting portion on the upper, inner peripheral surface of the outer flange 606.

In addition, while the ridges 621 for caulking are shown in the figure as being provided at four locations, they are sufficient to be provided at more than three locations and with an equal distance, or they may be provided over the entire circumference.

Figure 13:
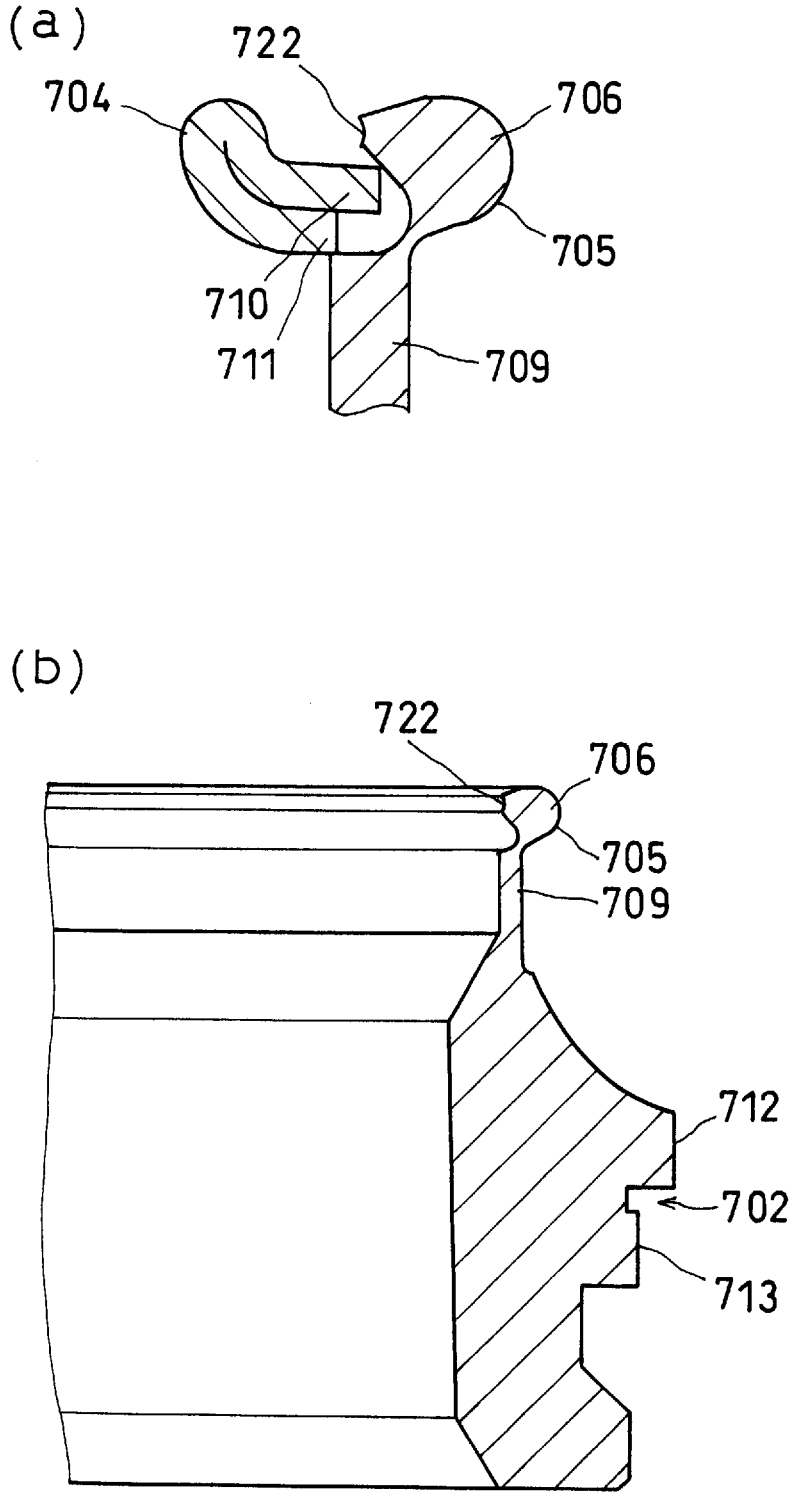
FIG. 13 is an end view A showing a ring flange portion of a spinning ring according to a still further embodiment of the invention, and a cross sectional view B showing a part of an outer flange.

A spinning ring shown in FIG. 13 is constructed such that an inner flange 704 is fixed by threads, a part of an upper surface on an inner peripheral side of an outer flange 706 is cut away over an entire circumference, an upper, inner peripheral surface of the outer flange is stepped in shape, the stepped, inner peripheral surface defines a fitting portion adapted to be fitted onto the inner flange 704, a threaded portion 722 is provided above the fitting portion of the outer flange 706, there is provided on an outer periphery of the outer flange an engaging portion 705, which engages with an outer foot portion of a ring traveller and is defined by a single or plural arcuate surfaces, and a mount portion 702 having a support flange portion 712 and a fit-in portion 713 on an outer peripheral surface thereof is provided contiguous to the outer flange with a ring neck portion 709 therebetween, the ring neck portion 709 being provided on an inner, lower portion of the outer flange. The outer flange 706, the ring neck portion 709 and the mount portion 702 are integrally formed.

The inner flange 704 is constructed such that an upper portion 710 of a fitting portion consisting of two upper and lower portions 710, 711 overlapped on one another in a stepped manner is threaded into the threaded portion 722 above the fitting portion of the outer flange 706 to be detachably fixed to the fitting portion on the upper, inner peripheral surface of the outer flange 706.

Figure 14:
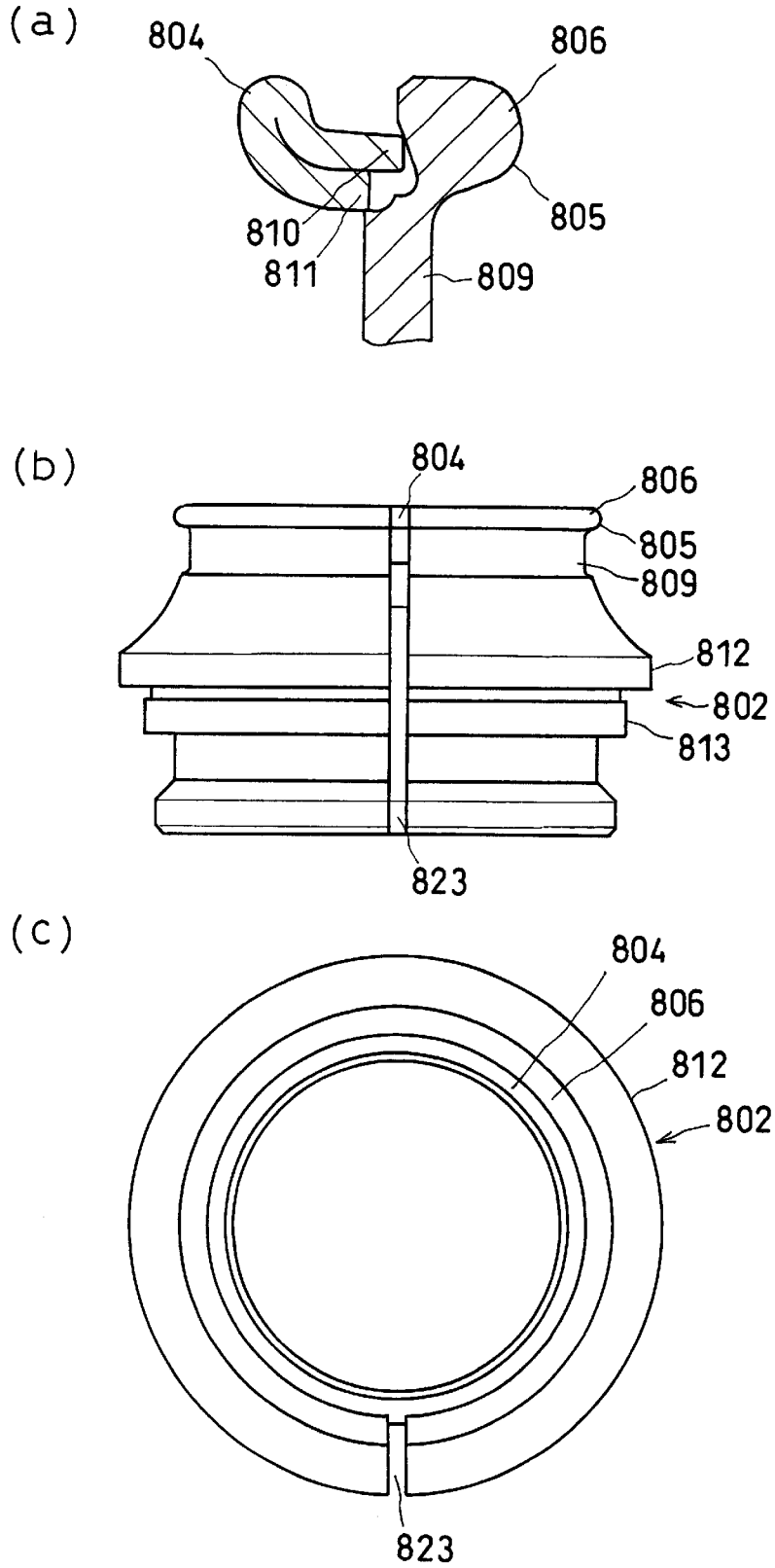
FIG. 14 is an end view A showing a ring flange portion of a spinning ring according to another embodiment of the invention, a front view B showing the spinning ring, and a plan view C showing the spinning ring.

A spinning ring shown in FIG. 14 is constructed such that an inner flange 804 is fixed to an outer flange 806 by elastic grasping, a part of an upper surface on an inner peripheral side of the outer flange 806 is cut away over an entire circumference, an upper, inner peripheral surface of the outer flange is stepped in shape, the stepped, inner peripheral surface defines a fitting portion adapted to be fitted onto the inner flange 804, there is provided on an outer periphery of the outer flange an engaging portion 805, which engages with an outer foot portion of a ring traveller and is defined by a single or plural arcuate surfaces, and a mount portion 802 having a support flange portion 812 and a fit-in portion 813 on an outer peripheral surface thereof is provided contiguous to the outer flange with a ring neck portion 809 therebetween, the ring neck portion 809 being provided on an inner, lower portion of the outer flange. The outer flange 806, the ring neck portion 809 and the mount portion 802 are integrally formed, and a slit 823 is provided over the entire height of the mount portion to be in parallel to the ring shaft.

The inner flange 804 is detachably fixed by expanding the outer flange 806 at the slit 823, fitting into the fitting portion of the outer flange 806 a fitting portion consisting of two upper and lower portions 810, 811 overlapped on one another in a stepped manner, and making use of the elastic force of the outer flange 806.

In addition, the slit 823 is shown in the figure as being provided in parallel to an axial direction of the ring but may be provided obliquely to the axial direction of the ring, in which case an inclination is preferably 45 degrees or less. Also, the slit preferably has a width of 0.1 to 0.5 mm.

Figure 15:
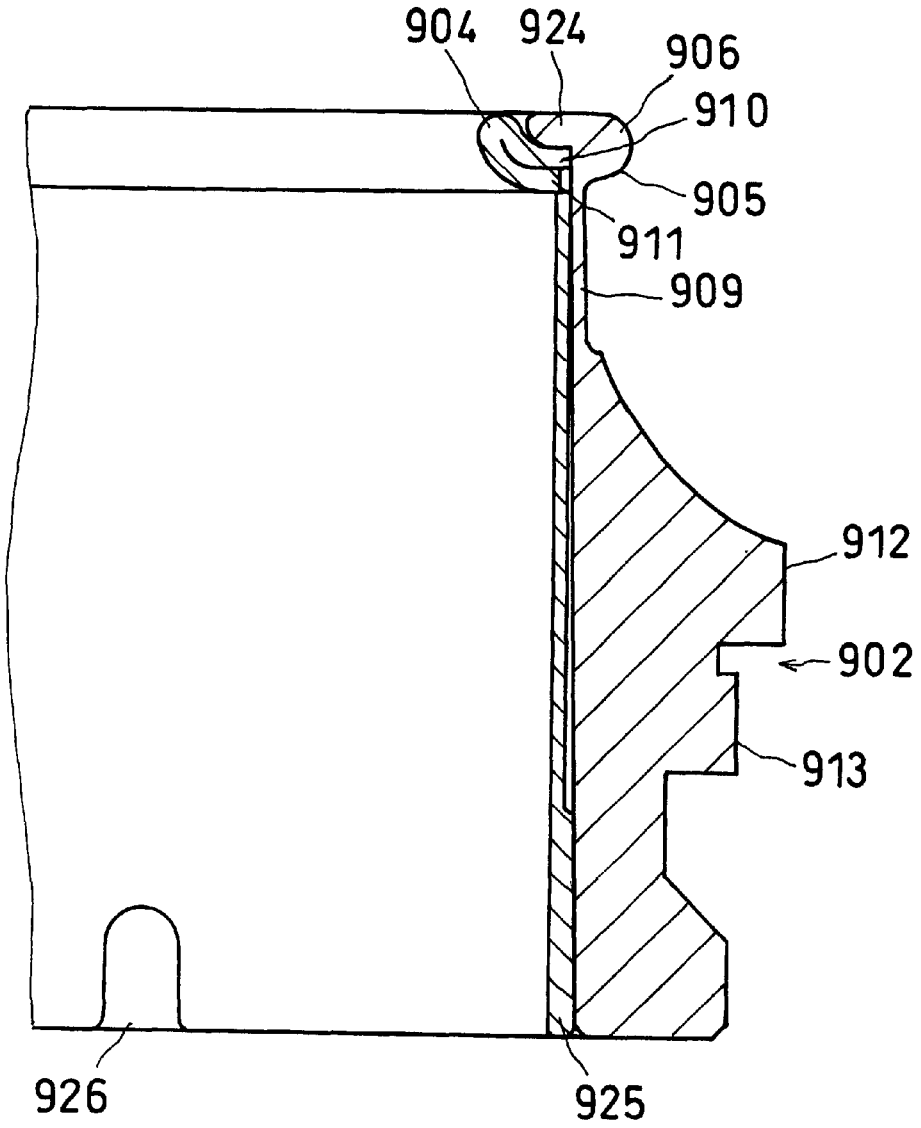
FIG. 15 is a cross sectional view showing a part of a spinning ring according to a still further embodiment of the invention.

A spinning ring shown in FIG. 15 is constructed such that an inner flange 904 is fixed by a press fit type fixing member 925, a flange 924 is provided over an entire circumference on an inner peripheral side of an upper end of an outer flange 906 to form on an upper, inner peripheral surface of the outer flange a fitting portion, an upper end of which corresponds to an underside of the flange 924, there is provided on an outer periphery of the outer flange an engaging portion 905, which engages with an outer foot portion of a ring traveller and is defined by a single or plural arcuate surfaces, and a mount portion 902 having a support flange portion 912 and a fit-in portion 913 on an outer peripheral surface thereof is provided contiguous to the outer flange 906 with a ring neck portion 909 therebetween, the ring neck portion 909 being provided on an inner, lower portion of the outer flange. The outer flange 906, the ring neck portion 909 and the mount portion 902 are integrally formed.

The inner flange 904 is detachably fixed by fitting into a fitting portion of the outer flange 906 a fitting portion, which consists of two upper and lower portions 910, 911 of the inner flange 904 overlapped in a stepped manner, from under, then press fitting the cylindrical-shaped fixing member 925, and interposing the fitting portion of the inner flange 904 between an underside of the flange 924, which constitutes an upper end of the fitting portion of the outer flange 906, and an upper surface of the fixing member 925.

The cylindrical-shaped fixing member 925 is facilitated in press fitting by making a height, as shown in the figure, sized to make a lower end of the fixing member 925 flush with a lower end of the mount portion 902 in a mounted state to enable readily judging an appropriate screwed position, and making an outer diameter of a lower portion of the fixing member 925 larger than that of an upper portion thereof to provide a greater clamping force, and by further providing notches 926 at one or several locations on a lower end thereof.

Figure 16:
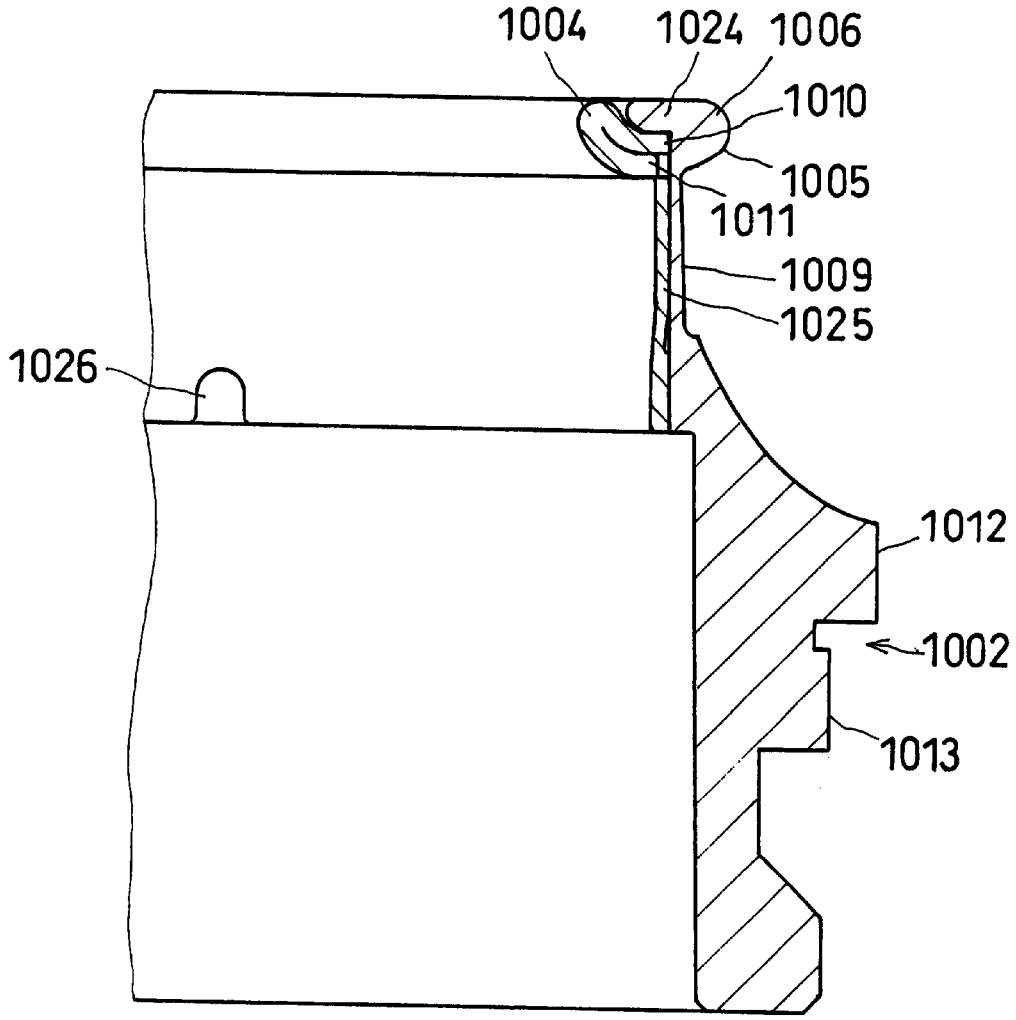
FIG. 16 is a cross sectional view showing a part of a spinning ring according to a yet another embodiment of the invention.

Like the example of FIG. 15, a spinning ring shown in FIG. 16 is constructed such that an inner flange 1004 is fixed by a press fit type fixing member 1025, a flange 1024 is provided over an entire circumference on an inner peripheral side of an upper end of an outer flange 1006 to form on an upper, inner peripheral surface of the outer flange 1006 a fitting portion, an upper end of which corresponds to an underside of the flange 1024, there is provided on an outer periphery of the outer flange an engaging portion 1005, which engages with an outer foot portion of a ring traveller and is defined by a single or plural arcuate surfaces, and a mount portion 1002 having a support flange portion 1012 and a fit-in portion 1013 on an outer peripheral surface thereof is provided contiguous to the outer flange with a ring neck portion 1009 therebetween, the ring neck portion 1009 being provided on an inner, lower portion of the outer flange. The outer flange 1006, the ring neck portion 1009 and the mount portion 1002 are integrally formed.

The inner flange 1004 is detachably fixed by fitting into a fitting portion of the outer flange 1006 a fitting portion, which consists of two upper and lower portions 1010, 1011 of the inner flange 1004 overlapped in a stepped manner, from under, then press fitting the cylindrical-shaped fixing member 1025, and interposing the fitting portion of the inner flange 1004 between an underside of the flange 1024, which constitutes an upper end of the fitting portion of the outer flange 1006, and an upper surface of the fixing member 1025.

The cylindrical-shaped fixing member 1025 is facilitated in press fitting by making its height, as shown in the figure, sized to make a lower end of the fixing member 1025 somewhat lower than the ring neck portion 1009 in a mounted state, and further providing notches 1026 at one or several locations on a lower end thereof.

Figure 17:
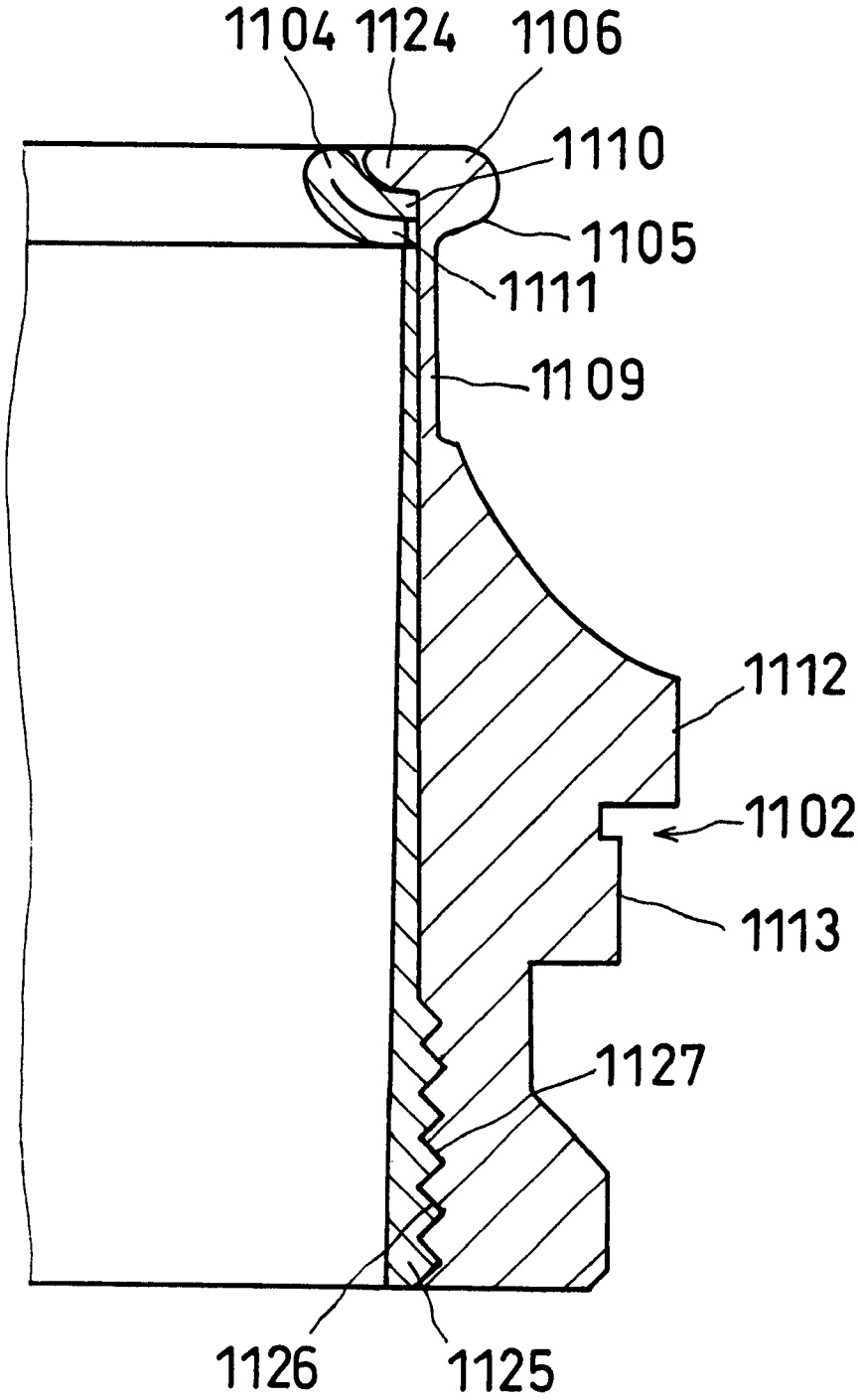
FIG. 17 is a cross sectional view showing a part of a spinning ring according to a still further embodiment of the invention.

A spinning ring shown in FIG. 17 is constructed such that an inner flange 1104 is fixed by a screw clamping type fixing member 1125, an outer flange 1106 is provided over an entire circumference thereof on an inner peripheral side of an upper portion thereof with a flange 1124, a fitting portion is formed on an upper, inner peripheral surface of the outer flange to have its upper end corresponding to an underside of the flange 1124, an engaging portion 1105, which engages with an outer foot portion of a ring traveller and is defined by a single or plural arcuate surfaces, is provided on an outer periphery of the outer flange, a mount portion 1102 having on an outer peripheral surface thereof a support flange portion 1112 and a fit-in portion 1113 with a ring neck portion 1109 therebetween, the ring neck portion being provided on an inner, lower portion thereof is provided contiguous to the outer flange. A threaded portion 1126 is formed on a lower, inner periphery of the mount portion 1102, and the outer flange 1106, the ring neck portion 1109 and the mount portion 1102 are formed integral with one another.

The inner flange 1104 is detachably fixed by fitting into a fitting portion of the outer flange 1106 a fitting portion, which consists of two upper and lower portions 1110, 1111 of the inner flange 1104 overlapped in a stepped manner, from under, then inserting a cylindrical-shaped fixing member 1125 provided at a lower, outer periphery thereof with a threaded portion 1127 to effect threading of the threaded portions 1126, 1127, and interposing the fitting portion of the inner flange 1104 between an underside of the flange 1124, which constitutes an upper end of the fitting portion of the outer flange 1106, and an upper surface of the fixing member 1125.

The cylindrical-shaped fixing member 1125 has a height, as shown in the figure, sized to make a lower end of the fixing member 1125 flush with a lower end of the mount portion 1102 in a mounted state to enable readily judging an appropriate screwed position.

Figure 18:
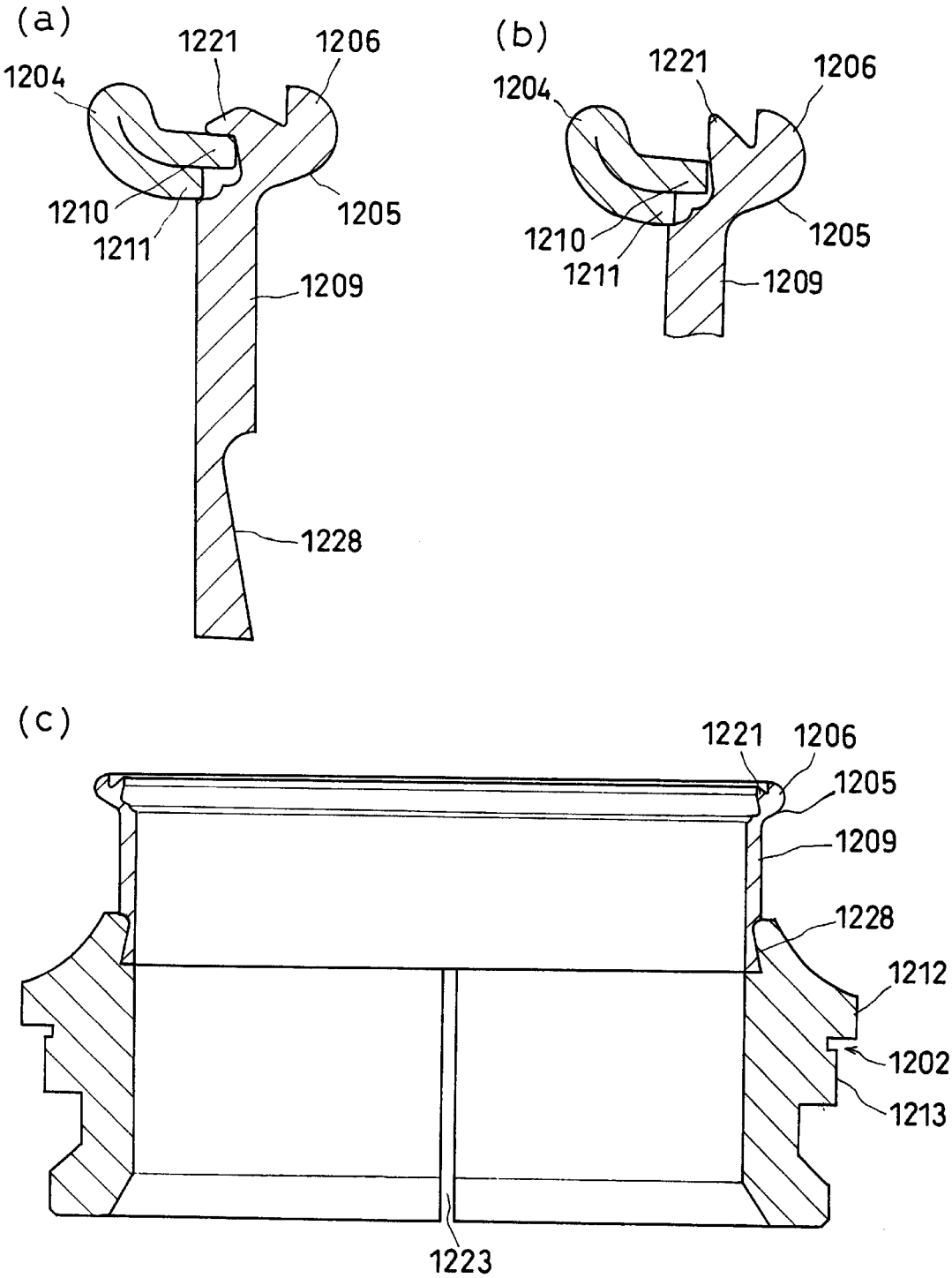
FIG. 18 is an end view A showing a ring flange portion of a spinning ring according to a further embodiment of the invention, an end view B showing the spinning ring prior to caulking, and a cross sectional view C showing an outer flange.

A spinning ring shown in FIG. 18 is constructed such that an outer flange 1206 and a mount portion 1202 are formed separately from each other to be fitted and secured to each other at a fitting portion. A part of an upper surface on an inner peripheral side of the outer flange 1206 is cut away over an entire circumference, an upper, inner peripheral surface of the outer flange is stepped in shape, the stepped, inner peripheral surface defines a fitting portion adapted to be fitted onto an inner flange 1204, ridges 1221 are provided above the fitting portion of the outer flange 1206 to fix thereto an upper surface of the inner flange 1204 by means of caulking, an engaging portion 1205 defined by a single or plural arcuate surfaces is provided on an outer peripheral portion of the outer flange to engage with an outer foot portion of a ring traveller, a ring neck portion 1209 is formed integrally with an inner, lower portion of the outer flange, and a mount portion 1228 for mounting to a ring holder is formed outwardly of and below the ring neck portion 1209 to be inclined at an inclination of 5° to 20°.

A fitting portion consisting of two upper and lower portions 1210, 1211 of the inner flange 1204 overlapped in a stepped manner is made to be fitted into a fitting portion of the outer flange 1206, and the ridges 1221 provided above the fitting portion of the outer flange 1206 is then caulked to integrally fix the upper portion 1210 of the fitting portion of the inner flange 1204 to the fitting portion on the upper, inner peripheral surface of the outer flange 1206.

In addition, while the ridges 1221 for caulking are shown in the figure as being provided at four locations, they may be provided at more than three locations, preferably, three to eight locations, or over the entire circumference.

Also, the mount portion 1202 mounted to a ring rail has on an outer peripheral surface thereof a support flange portion 1212 and a fit-in portion 1213 for mounting to the ring rail, a part thereof on an upper, inner peripheral side is cut away over the entire circumference, an upper, inner peripheral surface thereof is stepped in shape to define a fitting portion having an inclination of 5° to 20° and fitted onto a lower, outer periphery of the ring neck portion 1209 unitary with the outer flange 1206, and a slit 1223 is provided over the entire height of the ring holder 1202 to have a spacing of 0.1 mm to 0.5 mm and be in parallel to the ring shaft.

The outer flange 1206 and the mount portion 1202 engages each other at the respective fitting portions, which have the same inclination, and are detachably fixed to each other by the elastic force of the mount portion 1202 provided with the slit 1223.

In addition, it is better to arrange a ring-shaped elastic member of rubber, a synthetic resin or the like between the respective fitting portions of the outer flange 1206 and the mount portion 1202 or to form irregular surfaces on the respective fitting portions as by the knurling work, thereby enhancing adhesion between the both and preventing turning of the outer flange 1206.

Figure 19:
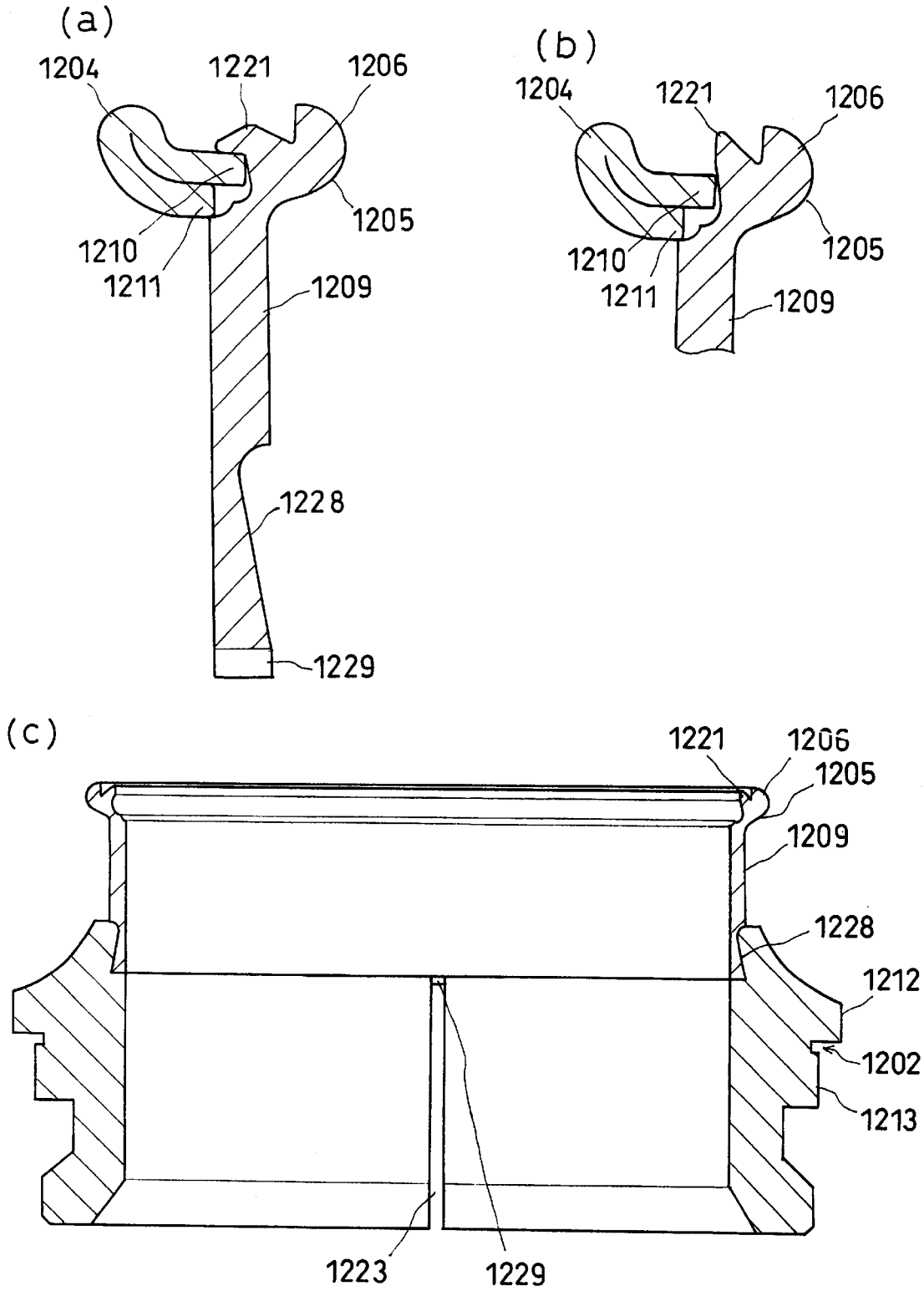
FIG. 19 is an end view A showing a ring flange portion of a spinning ring according to a still further embodiment of the invention, an end view B showing the ring flange portion prior to caulking, and a cross sectional view C showing an outer flange.
Figure 20:
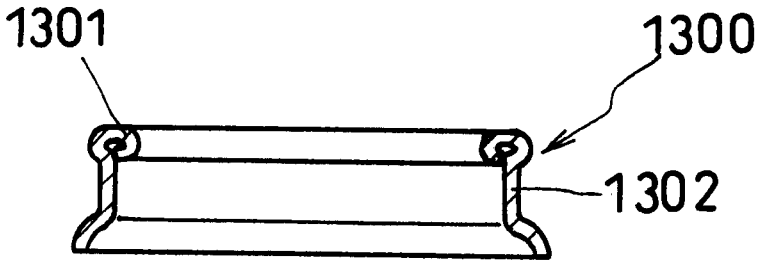
FIG.20 PRIOR ART
FIG. 20 is a cross sectional view showing a part of a conventional spinning ring.
Figure 21:
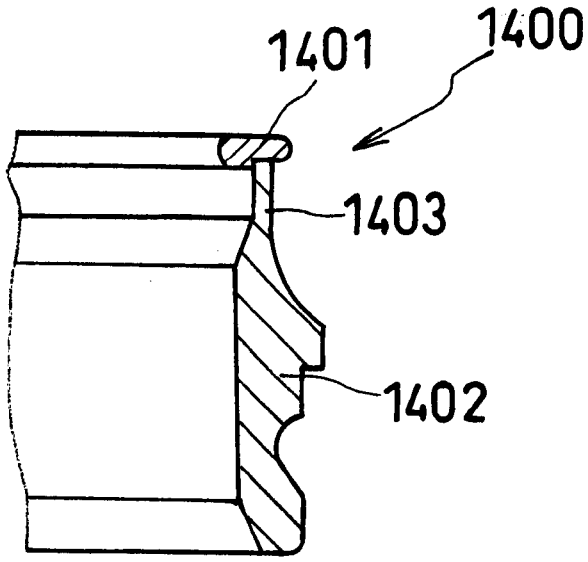
FIG.21 PRIOR ART
FIG. 21 is a cross sectional view showing a part of another conventional spinning ring.

A spinning ring shown in FIG. 19 is formed by providing a projection 1229 on an underside of the ring neck portion 1209 of the outer flange 1206 on the spinning ring of FIG. 18, so that engagement of the projection 1229 with the slit 1223 of the mount portion 1202 prevents the outer flange 1206 from turning.

Accordingly, it should be understood that we intend to cover by the appended claims all modifications falling within the true spirit and scope of our invention.

What is claimed is:

1. A spinning ring for a ring spinning machine provided with a ring flange portion, which permits a ring traveller to run thereon in a sliding contact condition, the ring flange portion composed of an inner flange and an outer flange, the inner flange being formed with a running surface of the traveller, which is formed by folding back an inner peripheral portion of a doughnut-shaped disk blank toward an outer peripheral side of the blank to be disposed on a folded-back, inner peripheral side of the blank and adapted to slidingly contact with a foot portion of a ring traveller, and with a fitting portion, which is disposed on the outer peripheral side of the blank to fit onto the outer flange, the outer flange being formed integral with a mount portion, which is mounted to a ring rail or a ring holder through a neck portion, and being provided on an inner peripheral side thereof with a fitting portion, which is adapted to be fitted onto the inner flange, and on an outer peripheral side thereof with an engaging portion, which is adapted to engage with the foot portion of the ring traveller, the inner flange and the outer flange fitting together and being integrated together by a securing means.

2. The spinning ring according to claim 1, wherein the securing means is by press fit, caulking, shrinkage fit, welding or bonding, or by press fit, thread fastening or elastic grasping.

3. A spinning ring provided with a ring flange portion, which permits a ring traveller to run thereon in a sliding contact condition, the ring flange portion composed of an inner flange and an outer flange, the inner flange being formed with a curved surface of predetermined shape, which is formed by folding back an inner peripheral portion of a doughnut-shaped disk blank toward an outer peripheral side of the blank and bending the inner peripheral portion of the folded-back blank upward and which is disposed on the bent, inner peripheral portion to define a running surface of the traveller, and with a fitting portion, which is disposed on the outer peripheral side of the blank to fit onto the outer flange, the outer flange being formed integral with a mount portion, which is mounted to a ring rail or a ring holder through a neck portion, and being provided on an inner peripheral side thereof with a fitting portion, which is adapted to be fitted onto the inner flange, and on an outer peripheral side thereof with an engaging portion, which is adapted to engage with the foot portion of the ring traveller, the inner flange and the outer flange fitting together and being integrated together by a securing means.

4. The spinning ring according to claim 3, wherein the securing means is by press fit, caulking, shrinkage fit, welding or bonding, or by press fit, thread fastening or elastic grasping.

5. The spinning ring according to claim 3, wherein a synthetic resin adhesive is filled in a groove, which is formed on an upper surface of the ring flange portion by fitting of the inner flange and the outer flange.

6. The spinning ring according to any one of claims 1 to 5, wherein the inner flange is constructed such that an upper portion of two overlapping upper and lower portions of the blank thus folded back is larger than a lower portion and an outer peripheral portion is stepped to provide a fitting portion adapted to fit onto the outer flange, the outer flange is constructed such that a part of an upper surface on an inner peripheral side thereof is cut away over an entire circumference, an upper, inner peripheral surface is stepped in shape, and the stepped, upper, inner peripheral surface defines a fitting portion fitted onto the inner flange, and the fitting portion defined by the stepped, outer peripheral portion of the inner flange and the fitting portion defined by the stepped, upper, inner peripheral surface of the outer flange fit together.

7. The spinning ring according to any one of claims 1 to 5, wherein the inner flange is constructed such that overlapping upper and lower portions of the blank thus folded back has a gap allowing elastic deformation at outer peripheral portions thereof and the elastic, outer peripheral portions defines a fitting portion adapted to fit onto the outer flange, the outer flange is constructed such that a part of an upper surface on an inner peripheral side thereof is cut away over an entire circumference, an upper, inner peripheral surface is stepped in shape, a groove is provided below a cut-away portion of the upper, inner peripheral surface, and the portion provided with the groove defines a fitting portion adapted to fit into the inner flange, and the fitting portion defined by the elastic, outer peripheral portion of the inner flange and the groove below the cut-away portion of the upper, inner peripheral surface of the outer flange fit together.

8. The spinning ring according to any one of claims 1 to 5, wherein the inner flange is constructed such that overlapping upper and lower portions of the blank thus folded back defines a fitting portion adapted to fit onto the outer flange, the outer flange is constructed such that a part of an upper surface on an inner peripheral side thereof is cut away over an entire circumference, an upper, inner peripheral surface is stepped in shape, and the stepped, upper, inner peripheral surface defines a fitting portion fitted onto the inner flange, an outer peripheral surface of an upper portion above the fitting portion of the inner flange and an inner peripheral surface of the cut-away portion of the outer flange opposed to the outer peripheral surface, respectively, are inclined upwardly inwardly at an inclination of 3° to 12°, and the fitting portion defined by the outer peripheral portion of the inner flange and the fitting portion defined by the stepped, upper, inner peripheral surface of the outer flange fit together.

9. The spinning ring according to any one of claims 1 to 5, wherein the inner flange is constructed such that overlapping upper and lower portions of the blank thus folded back defines a fitting portion adapted to fit onto the outer flange, the outer flange is constructed such that a part of an upper surface on an inner peripheral side thereof is cut away over an entire circumference, an upper, inner peripheral surface is stepped in shape, and the stepped, upper, inner peripheral surface defines a fitting portion fitted onto the inner flange, an outer peripheral surface of an upper portion above the fitting portion of the inner flange and an inner peripheral surface of the cut-away portion of the outer flange opposed to the outer peripheral surface, respectively, are formed to be inclined upwardly inwardly at an inclination of 10° to 15°, a maximum diameter E of the upper portion of the inner flange and a minimum diameter C of the cut-away portion have a relationship $E \leqq C$, and there is formed a space between the fitting portions, and the fitting portion defined by the outer peripheral portion of the inner flange and the fitting portion defined by the stepped, upper, inner peripheral surface of the outer flange fit together, and an adhesive is filled and solidified in the space between the fitting portions.

10. The spinning ring according to claim 9, wherein the adhesive is a polymerization/condensation type one such as epoxy resin, phenol resin, cyanoacrylate or the like.

11. A method of manufacturing a spinning ring for a ring spinning machine provided with a ring flange portion, which permits a ring traveller to run thereon in a sliding contact condition, the spinning ring being composed of an inner flange formed from a thin sheet material by press work and an outer flange integral with a mount portion, which is mounted to a ring rail or a ring holder, the inner flange being formed into a predetermined shape sequentially through the step of punching a thin sheet material to form a circular-shaped disk blank, the burring prepared hole forming step of punching a central portion of the circular-shaped disk blank to form a doughnut-shaped disk blank, the burring step of bending an inner peripheral portion of the doughnut-shaped disk blank upright in a flange manner, the folding-back step of folding back the bent, inner peripheral portion of the doughnut-shaped blank toward an outer periphery of the blank to vertically overlap the same on the outer periphery to form a running surface of the traveller on the inner peripheral portion in the folded-back state, and the trimming step of punching the doughnut-shaped blank, on which the running surface of the traveller is formed through the folding-back step, to a predetermined outer diameter dimension, the outer flange integral with the mount portion being formed integrally from a cylindrical-shaped stock material by cutting or rolling, the inner flange thus formed being integrally secured to a fitting portion, which is formed on an outer peripheral side of the outer flange, by a securing type or detachable type securing means.

12. A method of manufacturing a spinning ring for a ring spinning machine provided with a ring flange portion, which permits a ring traveller to run thereon in a sliding contact condition, the spinning ring being composed of an inner flange formed from a thin sheet material by press work and an outer flange integral with a mount portion, which is mounted to a ring rail or a ring holder, the inner flange being formed into a predetermined shape sequentially through the step of punching a thin sheet material to form a circular-shaped disk blank, the burring prepared hole forming step of punching a central portion of the circular-shaped disk blank to form a doughnut-shaped disk blank, the burring step of bending an inner peripheral portion of the doughnut-shaped disk blank upright in a flange manner, the folding-back step of folding back the bent, inner peripheral portion of the doughnut-shaped blank toward an outer periphery of the blank to vertically overlap the same on the outer periphery, the bending step of bending the folded-back, inner peripheral portion of the blank upward to form a curved surface of predetermined shape, which defines a running surface of the traveller on the bent, inner peripheral portion, and the trimming step of punching the doughnut-shaped blank, on which the running surface of the traveller is formed through the folding-back step, to a predetermined outer diameter dimension, the outer flange integral with the mount portion being formed integrally from a cylindrical-shaped stock material by cutting or rolling, the inner flange thus formed being integrally secured to a fitting portion, which is formed on an outer peripheral side of the outer flange, by a securing type or detachable type securing means.

13. The method of manufacturing a spinning ring, according to claim 12, wherein a synthetic resin adhesive is filled in a groove, which is formed on an upper surface of the ring flange portion by fitting of the inner flange and the outer flange.

* * * * *